US008283097B2

(12) United States Patent
Maruyama et al.

(10) Patent No.: US 8,283,097 B2
(45) Date of Patent: Oct. 9, 2012

(54) PROCESS FOR PRODUCING TONER FOR ELECTROSTATIC CHARGE IMAGE DEVELOPMENT TONER FOR ELECTROSTATIC CHARGE IMAGE DEVELOPMENT

(75) Inventors: Masatoshi Maruyama, Joetsu (JP); Hiroya Kodama, Yokohama (JP); Masaya Oota, Yokohama (JP); Shiho Sano, Yokohama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 767 days.

(21) Appl. No.: 11/719,913

(22) PCT Filed: Nov. 21, 2005

(86) PCT No.: PCT/JP2005/021387

§ 371 (c)(1),
(2), (4) Date: May 22, 2007

(87) PCT Pub. No.: WO2006/054750

PCT Pub. Date: May 26, 2006

(65) Prior Publication Data

US 2007/0298344 A1 Dec. 27, 2007

(30) Foreign Application Priority Data

Nov. 22, 2004 (JP) ..... 2004-337714

(51) Int. Cl.
*G03G 9/087* (2006.01)

(52) U.S. Cl. ..... 430/109.3; 430/110.1; 430/137.15

(58) Field of Classification Search ..... 430/137.14, 430/137.15, 110.1, 109.3
See application file for complete search history.

(56) References Cited

U.S. PATENT DOCUMENTS

| | | | | |
|---|---|---|---|---|
| 3,974,078 | A * | 8/1976 | Crystal | 430/110.2 |
| 5,413,890 | A | 5/1995 | Mori et al. | |
| 5,460,915 | A | 10/1995 | Nakanishi et al. | |
| 5,688,625 | A | 11/1997 | Bertrand | |
| 5,852,151 | A | 12/1998 | Burroway et al. | |
| 5,853,939 | A | 12/1998 | Yanagibori et al. | |
| 5,869,215 | A * | 2/1999 | Ong et al. | 430/137.14 |
| 6,582,867 | B2 | 6/2003 | Serizawa et al. | |
| 2001/0033982 | A1 * | 10/2001 | Ishikawa et al. | 430/110.1 |
| 2002/0006569 | A1 * | 1/2002 | Akai et al. | 430/110.1 |
| 2002/0136975 | A1 * | 9/2002 | Shiraishi et al. | 430/110.1 |
| 2003/0232267 | A1 * | 12/2003 | Fields et al. | 430/108.8 |
| 2004/0142265 | A1 * | 7/2004 | Tomita et al. | 430/108.4 |
| 2006/0216624 | A1 * | 9/2006 | Ueda et al. | 430/108.4 |

FOREIGN PATENT DOCUMENTS

| | | |
|---|---|---|
| EP | 0 651 292 A1 | 10/1994 |
| EP | 0 703 505 A1 | 3/1996 |
| EP | 1 109 069 A3 | 6/2001 |
| JP | 05-100473 | 4/1993 |
| JP | 06-148936 | 5/1994 |
| JP | 06-194874 | 7/1994 |
| JP | 6-194877 | 7/1994 |
| JP | 7-225496 | 8/1995 |
| JP | 07-301949 | 11/1995 |
| JP | 08-062894 | 3/1996 |
| JP | 08-095294 | 4/1996 |
| JP | 08-146659 | 6/1996 |
| JP | 9-34170 | 2/1997 |
| JP | 09-034171 | 2/1997 |
| JP | 09-034172 | 2/1997 |
| JP | 9-96920 | 4/1997 |
| JP | 11-1519 | 1/1999 |
| JP | 11-044967 | 2/1999 |
| JP | 2002-72534 | 3/2002 |
| JP | 2002-82487 | 3/2002 |
| JP | 2002 82487 | 3/2002 |
| JP | 2002-108018 | 4/2002 |
| JP | 2002 372805 | 12/2002 |
| JP | 2004-191822 | 7/2004 |
| JP | 2004 191822 | 7/2004 |

OTHER PUBLICATIONS

English language machine translation of JP 2004-191822 (Jul. 2004).*

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

To provide a process for efficiently producing a toner for developing an electrostatic charge image, which is scarcely susceptible to aggregation of the toner and free from blocking during the storage or from soiling the image forming apparatus and which is excellent in image characteristics. A process for producing a toner for developing an electrostatic charge image, characterized by supplying a monomer into a dispersion containing wax and a polymerizable monomer having a $C_{8-100}$ hydrocarbon group, carrying out the polymerization, followed by flocculation treatment.

11 Claims, 9 Drawing Sheets

U(2,5)-4.tif
H3KSA04(St-Ac=1 )
Print Mag = 20160x @ 150 mm
Acquired Oct 15, 2005 at 12:36

500 nm
HV=100kV
Direct Mag = 2500x
MITSUBISHI KAGAKU

S(2,5K)-4.tif
H3KSA06(St-Ac=0 )
Print Mag = 20160x @ 150 mm
Acquired Oct 15, 2005 at 11:52

500 nm
HV=100kV
Direct Mag = 2500x
MITSUBISHI KAGAKU

W(2,5)-7.tif
H3KSA07(St-Ac=2 )
Print Mag = 20160x @ 150 mm
Acquired Oct 15, 2005 at 1:28

500 nm
HV=100kV
Direct Mag = 2500x
MITSUBISHI KAGAKU

Y(2,5)-3.tif
H3KSA05(St-Ac=8 )
Print Mag = 20160x @ 150 mm
Acquired Oct 15, 2005 at 1:51

500 nm
HV=100kV
Direct Mag = 2500x
MITSUBISHI KAGAKU

PROCESS FOR PRODUCING TONER FOR ELECTROSTATIC CHARGE IMAGE DEVELOPMENT TONER FOR ELECTROSTATIC CHARGE IMAGE DEVELOPMENT

TECHNICAL FIELD

The present invention relates to a toner for developing an electrostatic charge image, which is useful for e.g. a copying machine and a printer of an electrophotographic system, and a process for its production. Particularly, it relates to a toner for developing an electrostatic charge image, which has no substantial leaching out of wax on the surface of the toner and which is free from blocking during the storage or from soiling the image forming apparatus and excellent in image characteristics, and a process for efficiently producing such a toner for developing an electrostatic charge image.

BACKGROUND ART

In order to make image information visible by means of an electrophotographic method an electrostatic latent image is firstly formed on a photoconductor drum of an image-forming apparatus, then it is developed with a toner and then transferred to e.g. transfer paper, and the transferred image is fixed by e.g. heat to form a visible image. Heretofore, a toner commonly employed has been produced by a so-called melt-kneading pulverization method i.e. a method wherein an antistatic agent, a magnetic material, etc., are dry-mixed to a binder resin such as a styrene/acrylate copolymer or a polyester produced by various methods and a colorant, as the case requires, and the mixture is then melt-kneaded by e.g. an extruder, followed by pulverization and classification.

In recent years, a low temperature fixing property and reduction of the particle size of the toner have been required more than ever in order to accomplish a high image quality and high speed desired for printers or copying machines. As a method to improve the melt kneading pulverization method from such a viewpoint, a suspension polymerization method wherein a mixed liquid containing a polymerizable monomer, a colorant and a polymerization initiator is suspended or dispersed in an aqueous medium to form droplets of a suitable size, followed by polymerization to obtain toner particles, or an emulsion polymerization flocculation method wherein a colorant and optionally an antistatic agent, etc., are added to a dispersion of primary particles of a polymer obtained by emulsion polymerization to carry out flocculation and aging to obtain toner particles, has been proposed and practically employed. When a toner is obtained by such a production method so-called a polymerization method, control of the particle size of the toner is easy and it is possible to obtain a toner having a small particle size and a narrow particle size distribution. Further, in the case of the polymerization method, no pulverization step is required, and it is possible to produce a toner using a binder resin having a low softening point, and it is possible to obtain a toner with a high resolution and excellent in the low temperature fixing property.

On the other hand, even such a toner having the low temperature fixing property improved has had a problem that the temperature range for fixing is not necessarily secured, and if fixing is attempted at a high temperature, offset is likely to result. To prevent such offset, it is common to add wax to the toner. With a release agent such as wax, the effect to suppress offset (the releasing effect) can be expected depending upon the amount. However, if wax is incorporated in a large amount relative to the toner, such a phenomenon is likely to occur that wax leaches out on the toner surface, or that the wax is liberated from the toner. As a result, there has been a problem such that the toner or the liberated wax soils various portions of the image-forming apparatus; or the toner itself is likely to be degraded by a phenomenon such that the toner undergoes blocking during the storage or an external additive on the toner surface is gradually embedded in the toner.

As a method for preventing wax in the toner from leaching out on the toner surface, a method was, for example, proposed wherein resin particles containing wax were coated with a resin containing no wax (e.g. Patent Document 1). However, when this method was employed, there was a case where no adequate release effect by wax was obtainable at the time of fixing. Further the affinity between the binder resin and wax was not good, whereby it was not possible to sufficiently prevent leaching out or liberation of wax on the toner surface.

Patent Document 1: JP-A-2002-82487

Further, in the slurry of toner particles obtained by a polymerization method, impurities such as an emulsifying agent, a suspension stabilizer, etc are present. If these impurities will remain as they are in a developer, a problem such as deterioration in the powder characteristics due to absorption of moisture will occur. Therefore, it is usually required to remove such impurities in the slurry by a step of e.g. filtration during the production of the toner. However, if it is attempted to incorporate wax in a large amount in the toner, there has been a problem that due to an influence of wax leached out on the toner surface or wax liberated from the toner clogging of the filter membrane is likely to occur during the filtration step, whereby the productivity of the toner has been substantially deteriorated.

A method has been proposed wherein the compatibility of wax and the binder resin is increased by using a binder resin obtainable from a polymerizable monomer containing a long chain alkyl acid ester and/or methacrylic acid ester, to make them readily compatible with each other (e.g. Patent Document 2). However, if this method is employed, the binder resin and wax tend to be compatible too much, whereby the diffusivity of wax in the binder resin tends to be so high that wax is likely to reach and leaches out on the toner surface in a short time. Further, if wax will not remain in the form of fine crystalline domains in the binder resin and will be molecularly dissolved, the binder resin tends to be plasticized. Therefore, there has been a drawback that inclusion of wax in the toner is deteriorated, whereby blocking resistance tends to be poor, or it becomes difficult to simultaneously satisfy the low temperature Fixing property and the high temperature offset.

Patent Document 2: JP-A-7-301949

Here, in a case where a toner is to be produced by an emulsion polymerization flocculation method, a method is known wherein a long chain alkyl acid ester and/or a methacrylic acid ester is employed. For example, Patent Document 3 discloses a toner comprising a binder resin containing a crystallizable resin employing stearyl (meth)acrylate and at least one member of resins having a contact angle with water smaller than the binder resin. However, also such a method is not sufficient for prevention of leaching out of wax on the toner surface.

Patent Document 3: JP-A-2002-108018

As described above, it has not been known how i is possible to add wax in a large amount in a toner and to prevent leaching out of wax on the toner surface or liberation of wax from the toner, and such has not been accomplished by prior art.

DISCLOSURE OF THE INVENTION

Object to be Accomplished by the Invention

The present invention has been made in view of the above-described prior art. Accordingly, it is an object of the present invention to provide a toner for developing an electrostatic charge image which has little leaching out of wax on the toner surface and which is free from blocking during the storage or from soiling of the image-forming apparatus and excellent in the image characteristics, and a process for efficiently producing such a toner for developing an electrostatic charge image.

Means to Accomplish the Object

The present inventors have conducted an extensive study to solve the above problems and as a result, have found it possible to solve the above problems by preliminarily dispersing wax and a specific polymerizable monomer in an aqueous dispersion in the process for producing a toner for developing an electrostatic charge image by an emulsion polymerization flocculation method, and has accomplished the present invention The present invention has been accomplished on the basis of such a discovery and it provides the following.

1. A toner for developing an electrostatic charge image which is a toner containing wax and is characterized in that the number of wax domains satisfying the following formula (1) among wax domains observed by its TEM analysis, is at least 85.0% of the total:
   (1) $0<A\leqq 500$ (A: equiareal circle diameter (nm))
2. A toner for developing an electrostatic charge image, which is a toner containing wax and is characterized in that the number of wax domains satisfying the following formula (2) among wax domains observed by its TEM analysis, is at least 60.0% of the total:
   (2) $0<A\leqq 350$ (A: equiareal circle diameter (nm))
3. A toner for developing an electrostatic charge image, which is a toner containing wax and is characterized in that the number of wax domains satisfying the following formula (3) among wax domains observed by its TEM analysis is at least 40.0% of the total:
   (3) $0<A\leqq 250$ (A: equiareal circle diameter (nm))
4. A toner for developing an electrostatic charge image, which is a toner containing wax and is characterized in that the number of wax domains satisfying the following formula (4) among wax domains observed by its TEM analysis, is at least 15.0% of the total:
   (4) $50<A\leqq 150$ (A: equiareal circle diameter (nm))
5. A toner for developing an electrostatic charge image, which is a toner containing wax and is characterized in that the main peak in the equiareal circle diameter distribution in number of wax domains observed by its TEM analysis, is present at less than 200 nm.
6. The toner for developing an electrostatic charge image according to any one of 1 to 6, which comprises a binder resin and wax and is characterized in that the binder resin contains a copolymer prepared by using, as a starting material, a polymerizable monomer having a $C_{8-100}$ hydrocarbon group, and the content of the polymerizable monomer having a $C_{8-100}$ hydrocarbon group is less than 2 wt % of the entire binder resin.
7. A process for producing a toner for developing an electrostatic charge image, characterized by supplying a monomer into an aqueous dispersion containing wax and a polymerizable monomer having a $C_{8-100}$ hydrocarbon group, carrying out the polymerization, followed by flocculation treatment.

Effects of the Invention

The toner of the present invention has little leaching out of wax on the toner surface, is not susceptible to liberation of wax from the toner and is free from blocking during the storage or from soiling of the image-forming apparatus and excellent in the image characteristics. Further, according to the process of the present invention, it is possible to incorporate wax in a large amount into a toner, to finely disperse the wax in the toner and to efficiently produce such a toner.

MEANING OF SYMBOL

1: wax domain

BEST MODE FOR CARRYING OUT THE INVENTION

Figure 1:
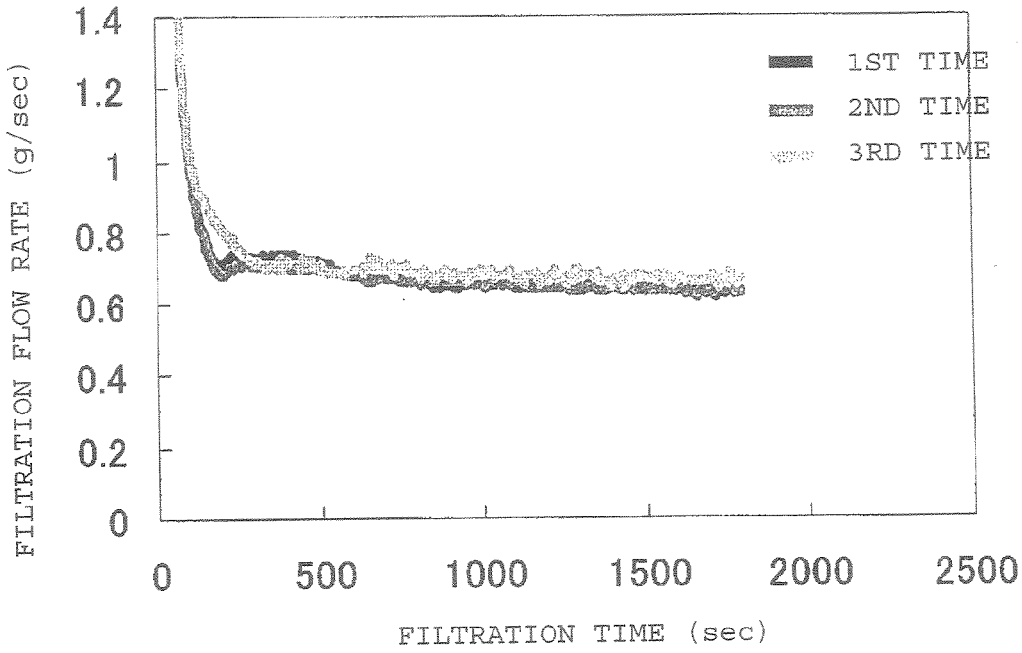
FIG. 1 shows the change with time of the filtration flow rate in a step of filtration/cleaning of toner A for development.

Now, the present invention will be described in detail with reference to preferred embodiments, but it should be understood that the present invention is by no means restricted to the following embodiments and may be practiced in various modifications within the range of the present invention.

The toner for developing an electrostatic charge image in the present invention comprises a binder resin, a colorant and wax and may contain an electrification-controlling agent and other additives, as the case requires.

In the present invention, the number of wax domains satisfying the following formula (1) among wax domains observed by a TEM analysis, is at least 85.0%, preferably at least 90.0%, based on the total.

(1) $0<A\leqq 500$ (A: equiareal circle diameter (nm))

Further, in the present invention, the number of wax domains satisfying the following formula (2) among wax domains observed by its TEM analysis, is at least 60.0%1 preferably at least 0.0% of the total:

(2) $0<A\leqq 350$ (A: equiareal circle diameter (nm))

Further, in the present invention, the number of wax domains satisfying the following formula (3) among wax domains observed by its TEM analysis is at least 40.0% preferably at least 50.0%, of the total:

(3) $0<A\leqq 250$ (A: equiareal circle diameter (nm))

Further, in the present invention, the number of wax domains satisfying the following formula (4) among wax domains observed by its TEM analysis is at least 15.0% preferably at least 25.0%, of the total:

(4) $50<A\leqq 50$ (A: equiareal circle diameter (nm))

When the number of wax domains satisfying any one of the above formulae (1) to (4) is at least the above specified value based on the total of wax domains, the wax tends to scarcely leach out on the toner surface even if it is incorporated in a large amount. Namely, the dispersed state of wax domains within the above range is the best form when the wax is incorporated in a large amount. Such a dispersed state of wax domains can be attained, for examples by lowering the interfacial tension between the binder resin and the wax. On the other hand, if the wax domains depart from the above dispersed states wax domains tend to leach out on the toner surface or wax tends to be liberated from the toner, whereby the cleaning property of the toner will be deteriorated, and the production efficiency of the toner tends to be low.

Further, the toner in the present invention is a toner containing wax, wherein the main peak in the equiareal circle diameter distribution in number of wax domains observed by its TEM analysis, is present at less than 200 nm, and it preferably has such a main peak within a range of at least 100 and less than 200 nm. Here, the main peak is meant for a peak having the highest value in the equiareal circle diameter distribution. When the above range is satisfied, wax tends to scarcely leach out on the toner surface even if wax is incorporated in a large amount. Namely, the dispersed state of wax domains within the above range is the best form when wax is incorporated in a large amount. Such a dispersed stage of wax domains can be attained, for example, by lowering the interfacial tension between is the binder resin and the wax.

On the other hand, if the binder resin and wax are compatibilized by reducing the interfacial tension to the limit, wax tends to be compatible with the binder resin too much, and the diffusivity of wax in the binder resin tends to be so high that the wax reaches the toner surface in a short time and leaches out. Further, if wax is not present in the form of fine crystal domains in the binder resin and molecularly dissolved, the binder resin tends to be plasticized, and inclusion of wax in the toner tends to be deteriorated, whereby blocking resistance tends to be low, or it becomes difficult to simultaneously satisfy the low temperature fixing property and the high temperature offset, such being undesirable.

In the present invention, the polymerizable monomer having a $C_{8-100}$ hydrocarbon group to be used for the production of the toner may be selected for use from a wide range including conventional ones. (Hereinafter "a polymerizable monomer having a $C_{8-100}$ hydrocarbon group" may sometimes be referred to as "a long chain polymerizable monomer".

The long chain polymerizable monomer is meant for one wherein a polymerizable monomer and a $C_{8-100}$ hydrocarbon group are bonded, and it may suitably be selected for use depending upon the type of wax or the composition of the binder resin constituting the toner in the present invention. Further, compounds different in the carbon number, or long chain polymerizable monomers having the same carbon number but different structures, may be used in combination. The long chain polymerizable monomer may, for example, be represented by the following structure (5).

(5) A-B

A represents a polymerizable monomer, and B represents a $C_{8-100}$ hydrocarbon group.

The polymerizable monomer of the present invention is meant for a monomer having a functional group capable of radical polymerization. It is usually an unsaturated hydrocarbon having a polar group, such as (meth)acrylic acid. Further, it may be an unsaturated hydrocarbon group having polarity imparted as a whole by introducing a polar group to an unsaturated hydrocarbon such as ethylene, propylene or butadiene. In the present invention, (meth)acrylic acid is particularly preferred among them.

The hydrocarbon group constituting the long chain polymerizable monomer may be a saturated hydrocarbon group or an unsaturated hydrocarbon group, but preferably a saturated hydrocarbon group. If the monomer has an unsaturated hydrocarbon group, it may sometimes undergo a side reaction such as crosslinking during the polymerization process. Further, such a hydrocarbon group may be linear or branched, but preferably linear. In a case where the hydrocarbon group is branched, the number of branches is not limited, but when the longest hydrocarbon chain portion is regarded as the main chain, the number of branches directly branching out from the main chain is preferably from 1 to 3. Further, such a hydrocarbon group may have a halogen element or a functional group, but is particularly preferably constituted substantially by carbon and hydrogen. As the functional group, a hydroxyl group, a carboxyl group or an amino group may, for example, be mentioned.

Specific hydrocarbon chains may, for example, be octyl, nonyl, decyl, lauryl, cetyl, stearyl, eicosyl, tetracosyl, octacosyl, triacontyl, hexacontyl and heptacontyl. Among them, it is particularly preferred to have at least one member selected from lauryl, cetyl and stearyl.

Such a hydrocarbon group is substituted at the R portion when, for example, an acrylate is represented by $CH_2{=}CHCOOR$, a methacrylate by $CH_2{=}C(CH_3)COOR$ and butadiene compounds by $CH_2{=}CH{-}CR\ CH_2$ and $CH_2CH{-}CH{=}CHR$.

The carbon number in the $C_{8-100}$ hydrocarbon group is usually at least 8 preferably at least 10, more is preferably at least 12 and usually at most 100, preferably at most 60, more preferably at most 40, further preferably at most 22. If the carbon number is less than the above range, there will be no effect to prevent leaching out of wax on the toner surface or is liberation of wax from the toner such being undesirable. If it exceeds the above range, inclusion of wax tends to be excessively high, and wax tends to hardly leach out at the time of fixing, whereby its function as a release agent tends to be poor, such being undesirable.

Further, the long chain polymerizable monomer may be one having at least two portions to be directly involved in the polymerization in one molecule. However, if such a monomer is incorporated in a large amount, wax may be agglomerated by the polymerization, whereby the effect of the present invention may be impaired. Therefore, such a monomer is used preferably in an amount of at most 10 wt %, preferably at most 5 wt %, in the entire long chain polymerizable monomer.

In consideration of the foregoing, the long chain polymerizable monomer is particularly preferably a stearyl (meth) acrylate.

The toner in the present invention is preferably such that the binder resin contains a copolymer prepared by using the above long chain polymerizable monomer as a starting material, and the content of the above polymerizable monomer having a $C_{8-100}$ hydrocarbon group is less than 2 wt %, based on the entire binder resin.

The copolymer made of the polymerizable monomer containing the above long chain polymerizable monomer in the above binder resin will increase the dispersibility of wax in the toner and thus prevent leaching out of wax on the toner surface, by its presence at the interface between the binder resin and wax. To have this effect developed, the content of the polymerizable monomer having a $C^{8-100}$ hydrocarbon group is preferably less than 2 wt %.

In a case where the binder resin contains no long chain polymerizable monomer, the compatibility between the binder resin and wax deteriorates, and wax tends to be hardly included in the toner. Even if it is included, leaching out of the wax on the surface is likely to occur due to the interfacial tension. In such a case, the equiareal circle diameters of wax domains in the toner tend to increase. Specifically, the number of wax domains having an equiareal circle diameter of at least 500 nm tends to increase, and the number of wax domains having an equiareal circle diameter exceeding 500 nm tends to increase to a level of at least 15% in number of the total of wax domains.

On the other hand, also in a case where the content is higher than the above range, the equiareal circle diameters of wax domains in the finally obtained toner tend to be large. The reason is not clearly understood but it is considered that the balance in the copolymer composition between the long chain polymerizable monomer and the resin constituting monomer will be broken and as a result, the dispersion stability of wax domains tends to be hardly maintained, whereby increase of wax domains will be promoted. Specifically, the number of wax domains having an equiareal circle diameter of at least 500 nm will increase, and the number of wax domains having an equiareal circle diameter exceeding 500 nm tends to increase to a level of at least 15% in number of the total of wax domains. In a case where the content of the long chain polymerizable monomer is at least 5 wt %, it tends to increase at least 25%. Namely, to prevent increase of the size of wax domains in order to prevent leaching out of wax on the toner surface, it is important to incorporate the long chain polymerizable monomer appropriately.

The toner in the present invention contains wax. As such wax, various known ones suitable for toners may be used. It may, for example, be an olefin wax such as a low molecular weight polyethylene a low molecular weight polypropylene or a copolymer polyethylene; paraffin wax; an ester type wax having a long chain aliphatic group, such as behenyl behenate, a montanate or stearyl stearate; a vegetable wax such as hydrogenated castor oil carnauba wax, candelilla wax, rice wax, haze wax or jojoba oil; a ketone having a long chain alkyl group such as distearylketone; a silicone wax; a higher fatty acid such as stearic acid or its metal salt; a long chain aliphatic alcohol such as eicosanol; a carboxylic acid ester or partial ester of a polybasic alcohol, obtainable from a polyhydric alcohol such as glycerol or pentaerythritol and a long chain fatty acid; a higher fatty acid amide such as oleic amide or stearic amide; or a low molecular weight polyester. Two or more such waxes may be used in combination.

The amount of wax is preferably within a range of from 1 to 40 parts by weight, more preferably from 2 to 35 parts by weight, particularly preferably from 4 to 30 parts by weight, per 100 parts by weight of the binder resin.

If the content of wax is less than the above range, the performance such as the high temperature offset may not sufficiently be obtainable, and if it exceeds the above range, the blocking resistance tends to be inadequate, or wax tends to leach out from the toner to soil the apparatus.

Further, the content of wax in the toner is preferably at least 1 wt %, more preferably at least 2 wt %, further preferably at least 5 wt %, and preferably at most 40 wt %, more preferably at most 35 wt %, further preferably at most 30 wt % if the content of wax in the toner is less than the above range, the performance such as the high temperature offset is likely to be inadequate, and if it exceeds the above range, the blocking resistance tends to be inadequate, or the wax tends to leach out from the toner to soil the apparatus.

In the present invention, it is possible to finely disperse wax in the toner. Accordingly, it is possible is to prevent a problem of leaching out of wax on the toner surface even when wax is incorporated in an amount of 20 wt %, which used to be difficult, since wax tended to leach out on the toner surface.

In order to improve the fixing property of such wax, it is preferred that the wax has a melting point. The melting point of the wax is preferably at least 40° C., more preferably at least 50° C., particularly preferably at least 60° C. Further, it is preferably at most 120° C., more preferably at most 110° C., particularly preferably at most 100° C. If the melting point is too low, wax is likely to leach out on the surface after the fixing and tends to cause stickiness and if the melting point is too high the fixing property at a low temperature tends to be poor.

As compound species of wax, it is preferred to employ at least one member among a higher fatty acid ester wax, an olefin wax such as a copolymer polyethylene, a paraffin wax and a silicone wax.

Specifically, the higher fatty acid ester wax may, for example, be preferably an ester of a $C_{15-30}$ fatty acid with a monohydric to pentahydric alcohol, such as behenyl benenate, stearyl stearate, a stearic acid ester of pentaerythritol, or montanic acid glyceride. Further, the alcohol component constituting the ester is preferably one having from 10 to 30 carbon atoms in the case of a monohydric alcohol, or one having from 3 to 10 carbon atoms in the case of a polyhydric alcohol.

The silicone wax is not particularly limited so long as it is one containing silicon atoms in the main chain structure of the molecule. It may, for example, be an organopolysiloxane (dimethylsilicone), an organopolymetalosiloxane, an organopolysilazane, an organopolysilmethylene or an organopolysilphenylene, having in its side chain an alkyl group such as a methyl group, an ethyl group, a propyl group or a butyl group, or an aryl group such as a phenyl group, a phenol group, a styryl group or a benzyl group. Further, such a compound may be one having its side chain or molecular terminal modified by e.g. an amino group, an epoxy group, a mercapto group, a carboxyl group, a hydroxyl group, an alkoxysilyl group a carbinol group, an alkoxy group, an alkyl group, an aralkyl group or a polyether, or one modified by halogenation such as fluorination or chlorination. Further, it may be a block copolymer or a graft copolymer constituted by a chain containing silicon atoms in the main chain structure of the molecule and a chain not containing silicon atoms in the main chain structure of the molecule.

Among them, a dimethylpolysiloxane (a dimetylsilicone resin) or a modified dimethylpolysiloxane is preferred.

Further, not only one having a linear structure, it may be one having a cyclic structure or a network structure i.e. a partially crosslinked structure.

The monomer to be used for the toner in the present invention may be selected for use from a wide range including conventional ones. Usually, it is preferred to use a monomer having a Brønsted acidic group (hereinafter sometimes referred to simply as an acidic group) or a monomer having a Brønsted basic group (hereinafter sometimes referred to simply as a basic group) and a monomer having neither Brønsted acidic group nor Brønsted basic group (hereinafter sometimes referred to simply as other monomer) in combination. These monomers are sequentially added to carry out the polymerization. In such a case, the monomers may be added separately, or a plurality of monomers may be preliminarily mixed and simultaneously added. Further, it is possible that during the addition of the monomers, the monomer composition may be changed. Further, the monomers may be added as they are, or they may be added in the form of a dispersion preliminarily prepared by mixing with water, an emulsifying agent, etc.

The monomer having a Brønsted acidic group to be used in the present invention may, for example, be a monomer having a carboxyl group such as acrylic acid, methacrylic acid, maleic acid, fumaric acid or cinnamic acid, a monomer having a sulfonate group such as styrene sulfonate, or a monomer having a sulfonamide group such as vinylbenzene sulfonamide.

Further, the monomer having a Brønsted basic group is may, for example, be an aromatic vinyl compound having an amino group, such as aminostyrene, a monomer containing a nitrogen-containing heterocyclic ring such as vinylpyridine or vinylpyrrolidone, or a (meth)acrylate having an amino group, such as dimethylaminoethyl acrylate or diethylaminoethyl methacrylate.

Further, such a monomer having an acidic group and a monomer having a basic group may be present in the form of salts with the respective counter ions.

The blend ratio of such a monomer having a Brønsted acidic group or a Brønsted basic group in the monomer mixture constituting the primary particles of the polymer is preferably within a range of from 1 to 10 parts by weight, more preferably from 0 to 3 parts by weight, particularly preferably from 0 to 1.5 parts by weight, per 100 parts by weight of the binder resin. Among monomers having Brønsted acidic groups or Brønsted basic groups, acrylic acid or methacrylic acid is particularly preferred. Other monomers may, for example, be a styrene such as styrene, methylstyrene, dimethylstyrene, chlorostyrene, dichlorostyrene, p-tert-butylstyrene, p-n-butylstyrene or p-n-nonylstyrene; a (meth)acrylate such as methyl acrylate, ethyl acrylate, propyl acrylate, n-butyl acrylate, isobutyl acrylate, hydroxyethyl acrylate, ethylhexyl acrylate, methyl methacrylate, ethyl methacrylate, propyl methacrylate, n-butyl methacrylate isobutyl methacrylate, hydroxyethyl methacrylate or ethylhexyl methacrylate; an amide compound such as acrylamide, N-propylacrylamide, N,N-dimethylacrylamide, N,N-dipropylacrylamide, N,N-dibutylacrylamide or acrylic acid amide; and a vinyl compound such as vinyl acetate, vinyl propionate, vinyl butyrate, vinyl benzoate, vinyl methyl ether, vinyl ethyl ether vinyl isobutyl ether, vinyl methyl ketone, vinyl hexyl ketone or vinyl isopropyl ketone. Among them styrene or butyl acrylate may, for example, be particularly preferred.

In a case where a toner is produced by an emulsion polymerization flocculation method, it is particularly preferred that at least styrene is used as a copolymer component, and at least one of acrylic acid, methacrylic acid and an alkyl ester of acrylic acid or methacrylic acid is used as another copolymer component. Further, in a case where a crosslinked resin is employed for primary particles of the polymer, a polyfunctional monomer having radical polymerizability is used as a crosslinking agent used in combination with the above monomer, and, for example, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate or diallyl phthalate may, for example, be mentioned. Further, a monomer having a reactive group as a pendant group, such as glycidyl methacrylate, methylol acrylamide or acrolein may, for example, be used. Preferred is a radical polymerizable bifunctional monomer is preferred, and divinylbenzene or hexanediol diacrylate is further preferred.

The blend ratio of such a polyfunctional monomer in the monomer mixture is preferably within a range of from 0.05 to 10 parts by weight, more preferably from 0.1 to 5 parts by weight, particularly preferably from 0.2 to 3 parts by weight, per 100 parts by weight of the binder resin. By using a polyfunctional monomer in such a manner, when an image is formed by using a toner thereby obtained, there may be a case where high temperature offset will be good.

Such monomers may be used alone or as mixed, and in such a case, it is preferably adjusted so that the glass transition temperature of the obtainable polymer would be from 40 to 80° C. If the glass transition temperature exceeds 80° C., the fixing temperature tends to be too high, or deterioration of the transparency in full color, etc. is likely to be problematic. On the other hand, if the glass transition temperature of the polymer is less than 40° C., the storage stability of the toner sometimes tends to be poor. More preferably, the glass transition temperature is from 50 to 70° C., and particularly preferably, the glass transition temperature is from 55 to 65° C.

In the present invention, the binder resin prepared by polymerization of a monomer, or a monomer and a long chain polymerizable monomer, may, for example, be a styrene resin, a saturated or unsaturated polyester resin, an epoxy resin a polyurethane resin a vinyl chloride resin, a polyethylene, a polypropylene, an ionomer resin, a silicone resin, a rosin-modified maleic acid resin, a phenol resin, a ketone resin, an ethylene/ethyl acrylate copolymer or a polyvinyl butyral resin. Such binder resins may be used alone or in combination as a mixture of two or more of them. As a resin particularly preferred for use in the present invention, a styrene resin or a polyester resin may be mentioned, and particularly preferred is a styrene resin.

The styrene resin may be a homopolyser or a copolymer containing styrene or a styrene-derivative, such as a polystyrene, a chloropolystyrene, a poly-α-methylstyrene, a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylate copolymer, a styrene/acrylate/acrylic acid copolymer, a styrene/acrylate/methacrylic acid copolymer, a styrene/methacrylate copolymer, a styrene/methacrylate/acrylic acid copolymer, a styrene/methacrylate/methacrylic acid copolymer, a styrene/methyl α-chloroacrylate copolymer, or a styrene/acrylonitrile/acrylate copolymer. It may be their mixture. Further, the ester group in the acrylate or methacrylate is not particularly limited, but it may, for example, be a methyl ester, an ethyl ester, a butyl ester, an octylester or a phenylester. Further, one having a part or whole of the above acrylic acid or methacrylic acid substituted by a substituted monocarboxylic acid such as α-chloroacrylic acid or α-bromoacrylic acid, an unsaturated dicarboxylic acid such as fumaric acid, maleic acid, maleic anhydride or monobutyl maleate, an anhydride thereof or a half ester thereof, may also be suitably used.

Among them, it is particularly preferably at least one binder resin selected from the group consisting of a styrene/acrylate copolymer, a styrene/acrylate/acrylic acid copolymer, a styrene/acrylate/methacrylic acid copolymer, a styrene/methacrylate copolymer, a styrene/methacrylate/acrylic acid copolymer and a styrene/methacrylate/methacrylic acid copolymer, since it is excellent from the viewpoint of the fixing property and durability of the toner, and yet the electrostatic stability (particularly the negative electrostatic property) of the toner will be thereby improved.

The softening point (hereinafter referred to as Sp) of the binder resin is usually preferably at most 150° C., more preferably at most 140° C., for fixing with a low energy. Further, such Sp is preferably at least 80° C., preferably at least 100° C., from the viewpoint of high temperature offset resistance or durability. Here, such Sp can be obtained as a temperature at an intermediate point of a strand from the initiation to the termination of flow when 1.0 g of a sample is measured by a flow tester (CFT-500, manufactured by Shimadzu Corporation) with a nozzle of 1 mm×10 mm under such conditions that the load is 30 kg, the preheating time at 50° C. is 5 minutes and the temperature raising rate is 3° C./min.

Further, the glass transition point (hereinafter referred to as Tg) of the binder resin is usually preferably at most 80° C., more preferably at most 70° C., for fixing with a low energy. Further, such Tg is preferably at least 40° C., more preferably at least 50° C., from the viewpoint of blocking resistance. Here, such Tg can be obtained as a temperature at the intersection of two tangent line, when the tangent lines are drawn at the transition (curvature change) initiation portions of a curve measured by a differential scanning calorimeter (DTA-40, manufactured by Shimadzu Corporation) under a condition of a temperature raising rate of 10° C./min.

Sp and Tg of the binder resin in the present invention can be made within the above ranges by adjusting the type of the resin and the compositional ratio, the molecular weights of monomers, etc. Otherwise, among commercially available resins, one having Sp and Tg within the above ranges may be optionally selected for use.

In a case where the above-mentioned styrene resin is used as the binder resin, such a binder resin preferably has a number average molecular weight of at least 2,000, more preferably at least 2,500, further preferably at least 3,000 and preferably at most 50,000, more preferably at most 40,000 further preferably at most 35,000, by gel permeation chromatography (hereinafter referred to as GPC). Further, such a binder resin preferably has a weight average molecular weight of at least 50,000, more preferably at least 100,000, further preferably at least 200,000 and preferably at most 2,000,000, more preferably at most 1,000,000, further preferably at most 500,000, as obtained in the same manner. When the number average molecular weight and the weight average molecular weight of the styrene resin are within such ranges, the durability, storage stability and fixing property of the toner will be good, such being desirable. Here, the value of the average molecular weight by GPC is a value calculated as a monodisperse polystyrene standard sample.

The colorant to be used for the toner in the present invention may be any one of an inorganic pigment, an organic pigment and an organic dye, or a combination thereof. Specifically, it may, for example, be a metal powder such as iron powder or copper powder, a metal oxide such as red oxide, carbon black such as furnace black or lampblack, aniline blue, phthalocyanine blue, phthalocyanine green, hansa yellow, rhodamine dye or pigment, chromium yellow, quinacridone, benzidine yellow, rose bengal, a triallylmethane dye, a monoazo-, disazo-, or condensed azo-dye or pigment. Such known optional dyes and pigments may be used alone or as mixed.

As a yellow colorant, specifically, a pigment such as C.I. pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 1911, 191, 192, 193 or 199, or a dye such as C.I. solvent Yellow 33, 56, 79, 82, 93, 112, 162 or 163, or C.I. disperse Yellow 42, 64, 201 or 211, may, for example, be mentioned.

As a magenta colorant, specifically, C.I. pigment red 2, 3, 5, 6, 7, 23, 48:2, 48:3, 48:4, 57:1, 81:1, 122 146, 150, 166, 169, 177, 184 185, 202, 206, 220, 221, 238, 254, 255 or 269, or C.I. pigment violet 19, may, for example, be mentioned.

As a cyan colorant, specifically; C.I. pigment blue 1, 7, 15, 15:1, 15:2, 15:3, 15:4 60 62 or 66 may, for example, be mentioned.

In a case where the toner obtained by the process of the present invention is to be used for full color, the colorants to be used for the toner are preferably such that one for yellow is, for example, benzidine yellow, or a monoazo type or condensed azo type dye or pigment, one is for magenta is, for example, quinacridone or a monoazo type dye or pigment, and one for cyan is, for example, phthalocyanlne blue. The combination of colorants may optionally be selected in consideration of the hue, but among them, as a yellow colorant, C.I. pigment yellow 74 or C.I. pigment yellow 93 is preferably employed, and as a magenta colorant, C.I. pigment red 238, C.I. pigment red 269, C.I. pigment red 57:1, C.I. pigment red 48:2 or C.I. pigment red 122 is preferably employed, and as a cyan colorant, C.I. pigment blue 15:3 is preferably employed.

The content of the colorant may be at a level sufficient for the obtainable toner to form a visible image by development. For example, it is preferably within a range of from 1 to 25 parts by weight, more preferably from 1 to 15 parts by weight, particularly preferably from 3 to 12 parts by weight, per 100 parts by weight of the binder resin.

Further, the colorant may have magnetism, and the magnetic colorant may be a ferromagnetic substance showing ferrimagnetism or ferromagnetism in the vicinity of from 0 to 60° C. which is the operation temperature of printers, copying machines, etc. Specifically, it may, for example, be magnetite ($Fe_3O_4$), maghematite ($\gamma$-$Fe_2O_3$), an intermediate or mixture of magnetite and maghematite, a ferrite powder $MFe_2O_4$ (wherein M is a bivalent metal and at least one member selected from Mg, Mn, Co, Ni, Cu, Zn, Cd and Sr), a hexagonal ferrite such as $BaO.6Fe_2O_3$ or $SrO.6Fe_2O_3$, a garnet oxide such as $Y_3Fe_5O_{12}$ or $Sm_3Fe_2O_{12}$, a butyl oxide such as $CrO_2$, or one showing magnetism at a temperature in the vicinity of from 0 to 60° C. among metals such as Cr, Mn, Fe, Co and Ni, and their ferromagnetic alloys. Among them, magnetite, maghematite, or an intermediate of magnetite and maghematite is preferred. In a case where such a magnetic colorant is added with a view to preventing scattering or controlling the electrostatic property, while the characteristics as a non-magnetic toner are maintained, its amount is from 0.2 to 10 wt %, preferably from 0.5 to 8 wt %, more preferably from 1 to 5 wt %, further, in a case where the toner is used as a magnetic toner, the content of the above magnetic powder in the toner is usually at least 15 wt %, preferably at least 20 wt % and usually at most 70 wt %, preferably at most 60 wt %. If the content of the magnetic powder is less than the above range, no adequate magnetic power may sometimes be obtainable as a magnetic toner. On the other hand, if it exceeds the above range, such may cause failure in the fixing property.

In a case where electrical conductivity is to be imparted to the toner in the present invention, electrically conductive carbon black as the above colorant component, or other conductive material may be incorporated. The content of the conductive material is preferably at a level of from 0.05 to 5 wt % in the toner.

To the toner in the present invention an electrification-controlling agent may be added in order to adjust the electrostatic charge or to impart the electrostatic stability As such an electrification-controlling agent, a known compound may be used. For example, a positively chargeable electrification-controlling agent may, for example, be a nigrosine dye, a quaternary ammonium salt, a triaminotriphenylmethane compound, an imidazole compound or a polyamine resin. A negatively chargeable electrification-controlling agent may, for example, be an azo complex compound dye containing an atom such as Cr, Co, Al, Fe or B salicylic acid or an alkyl salicylic complex compound, a calyx(n)arene compound, a metal salt or metal complex of benzylic acid, an amide compound, a phenol compound, a naphthol compound, a phenolamide compound, or a hydroxynaphthalene compound such as 4,4'-methylenebis[2-[N-(4-chlorophenyl)amide]-3-hydroxynaphthalene].

In a case where the toner obtained by the process of the present invention is used for full color, it is necessary to choose the color of the electrification-controlling agent to be colorless or pale color in order to avoid a coloring trouble. For this purpose, the positively chargeable electrification-controlling agent is preferably a quaternary ammonium salt or an imidazole compound, and the negatively chargeable electrification-controlling agent is preferably salicylic acid or an alkylsalicylic acid complex compound containing an atom such as Cr, Co, Al, Fe, B or Zn, or a calyx(n)arene compound, among those mentioned above. Otherwise, it may be mixture thereof.

The amount of the electrification-controlling agent is preferably within a range of from 0.01 to 5 parts by weight, more preferably from 0.05 to 3 parts by weight, particularly preferably from 0.1 to 2 parts by weight, per 100 parts by weight of the binder resin.

Further, the toner of the present invention may contain various known internal additives such as a silicone oil, a silicone varnish, a fluorinated oil, etc for modification of the characteristics such as the viscosity, flocculation property, flowability, electrification-property, surface resistance, etc., of the toner.

Now, the process for producing a toner for developing an electrostatic charge image of the present invention will be described in detail. The process for producing a toner for developing an electrostatic charge image of the present invention is characterized by supplying a monomer into an aqueous dispersion containing wax and a polymerizable monomer having a $C_{8-100}$ hydrocarbon group, carrying out the polymerization, followed by flocculation treatment.

Here, a step of preliminarily preparing a dispersion containing wax and a polymerizable monomer having a $C_{8-100}$ hydrocarbon group, is essential, and such a dispersion is preferably emulsified. (Hereinafter, "the dispersion containing wax and a polymerizable monomer having a $C_{8-100}$ hydrocarbon group" may sometimes be referred to as "the wax-long chain polymerizable monomer dispersion".)

By having a step of preliminarily dispersing the long chain polymerizable monomer together with wax, the long chain polymerizable monomer is locally present at the interface between the wax and the binder resin, whereby wax can be finely dispersed stably in the binder resin. Therefore, it becomes possible to increase the wax content in the toner while leaching out of wax on the toner surface or liberation of wax from the toner can be prevented.

By a seed polymerization method, the seed material (wax) can be finely dispersed in the polymer in a size smaller than the volume dispersed particle diameter of the dispersion of the seed material, but the volume average dispersed particle diameter of the dispersion containing wax and the long chain polymerizable monomer is preferably at most 2 μm. If the volume average dispersed particle diameter of the dispersion exceeds 2 μm, it tends to be difficult to constantly produce a binder resin polymer having wax finely dispersed.

On the other hand, in a case where without preliminarily dispersing the long chain polymerizable monomer and wax, a polymerization initiator is added to an aqueous dispersion containing the long chain polymerizable monomer, wax and components such as a monomer, a colorant, an emulsifying agent, etc., the affinity between the binder resin and wax may certainly be improved. However, in this method, the compatibilizing effect works more than the effect for finely dispersing wax in the toner, whereby the blocking resistance tends to deteriorate. Further, in a case where primary particles of a polymer are produced by emulsion polymerization using wax as seeds, and they are flocculated and aged to produce a toner, if without preliminarily dispersing the long chain polymerizable monomer and wax, the long chain polymerizable monomer is subsequently added and polymerized, the polymerizability tends to be poor.

Further, a monomer other than the long chain polymerizable monomer may be incorporated to the wax-long chain polymerizable monomer dispersion. Such a monomer is not limited, and for example, it may be used as selected from monomers which may be used for emulsion polymerization for primary particles of the polymer, and two or more types may be used in combination.

The method for preparing the wax-long chain polymerizable monomer dispersion is not limited. Namely, it may be prepared by dispersing wax only, and then adding the long chain polymerizable monomer thereto, or a dispersion of wax and a dispersion of the long chain polymerizable monomer may be prepared, respectively, and then mixed to prepare the dispersion. It is particularly preferred to prepare it by dispersing wax and the long chain polymerizable monomer simultaneously.

In the present invention, the long chain polymerizable monomer may sometimes serves as a dispersing aid at the time of dispersing wax. Accordingly, by selecting wax, it is possible to disperse the wax sufficiently even with a small amount of an emulsifier. In such a case, it is preferred to disperse wax and the long chain polymerizable monomer at the same time. As a suitable wax, a paraffin wax may, for example, be mentioned.

The emulsifier to be used for preparing the wax-long chain polymerizable monomer dispersion is not limited, and it may optionally be selected for use among the same as emulsifiers to be used at the time of flocculating primary particles of the polymer as described later. The content of the emulsifier is not limited, but it is preferably at least 0.01 wt %, more preferably at least 0.05 wt % and preferably at most 10 wt %, more preferably at most 5 wt %, in the wax-long chain polymerizable monomer dispersion. If the content of the emulsifier in the wax-long chain polymerizable monomer dispersion is less than the above range, there may be a case where a stable dispersion is hardly obtainable, and if it exceeds the above range, there may be a case where the subsequent polymerization step tends to be difficult due to the emulsifier excessively present. Further, together with such an emulsifier, one or more of polyvinyl alcohols such as partially or completely saponified polyvinyl alcohol, and cellulose derivatives such as hydroxy ethylcellulose, may be used in combination as a protective colloid.

The content of wax in the wax-long chain polymerizable monomer dispersion is not limited, but it is preferably at least 1 wt %, more preferably at least 5 wt % and preferably at most 80 wt %, more preferably at most 50 wt %. If the content of wax in the wax-long chain polymerizable monomer dispersion is less than the above range, there may be a case where the efficiency decreases as a step to produce the toner, or no adequate release effect by wax tends to be obtainable. If it exceeds the above range, there may be a case where a stable wax-long chain polymerizable monomer dispersion tends to be hardly obtainable, or wax tends to leach out on the toner surface.

The content of the long chain polymerizable monomer in the wax-long chain polymerizable monomer dispersion is not limited, but it is preferably at least 0.001 wt %, more preferably at least 0.005 wt % and preferably at most 30 wt %, more preferably at most 15 wt %. If the content of the long chain polymerizable monomer in the wax-long is chain polymerizable monomer dispersion is less than the above range, there may be case where the efficiency decreases as a step for producing the toner, or wax tends to leach out on the toner surface. If it exceeds the above range, there may be a case where a wax-long chain polymerizable monomer dispersion can hardly be obtainable, or no adequate release effect by wax tends to be obtainable.

The content of the long chain polymerizable monomer per 100 parts by weight of wax in the wax-long chain polymerizable monomer dispersion is not limited, but it is preferably at least 0.01 part by weight, more preferably at least 0.1 part by weight further preferably at least 1 part by weight and preferably at most 50 parts by weight, more preferably at most 35 parts by weight further preferably at most 20 parts by weight. If the content of the long chain polymerizable monomer based on the wax is less than the above range, inclusion of wax tends to be poor, whereby the wax tends to leach out on the toner surface, and if it exceeds the above range, there may be a case where no adequate release effect by wax tends to be obtainable.

Further, the wax and the long chain polymerizable monomer may be compatible or not compatible with each other, but they may be preferably compatible from the viewpoint of the stability of the dispersion. Further, when they are compatible, there may be a case where the dispersed particle diameters of wax in the obtainable toner may be made finer. Here, whether or not the wax and the long chain polymerizable monomer are compatible, can be judged by whether or not the wax and the long chain polymerizable monomer can be uniformly mixed or non-uniformly mixed (undergo phase separation) when they are solely mixed.

The average particle diameter of the wax-long chain polymerizable monomer dispersion is preferably at least 0.01 μm, more preferably at least 0.05 μm, further preferably at least 0.1 μm and preferably at most 2 μm, more preferably at most 1.5 μm, further preferably at most 1 μm. Here, the average particle diameter may, for example, be measured by means of LA-500, manufactured by Horiba Ltd. If the average particle diameter of the wax-long chain polymerizable monomer dispersion exceeds the above range, it tends to be difficult to constantly produce a binder resin polymer having wax finely dispersed and if it is less than the above range, it tends to be difficult to obtain a desired particle size distribution by seed polymerization.

The process for producing a toner for developing an electrostatic charge image of the present invention is characterized by supplying a monomer into an aqueous dispersion containing wax and the long chain polymerizable monomer, carrying out the polymerization, followed by flocculation treatment.

Here, in the polymerization step, polymerization may be carried out at the time of the wax-long chain polymerizable monomer dispersion but without carrying out the polymerization at the time of the wax-long chain polymerizable monomer dispersion the polymerization can be carried out in the step of emulsion polymerization as described hereinafter (the dispersion obtained by the polymerization at the time of the wax-long chain polymerizable monomer dispersion may hereinafter sometimes be referred to as a wax-polymer dispersion). Otherwise , it is also possible that at the time of the wax-long chain polymerizable monomer dispersion the polymerization is carried out only partially without completing the polymerization, and the polymerization is completed in the subsequent step of emulsion polymerization (hereinafter sometimes referred to as a wax-partial polymer dispersion). Whether or not the polymerization be completed, can be adjusted by adjusting the amount of the initiator or the polymerization conditions (such as the temperature and time). Further, after completing the polymerization of the wax-long chain polymerizable monomer dispersion the long chain polymerizable monomer is further added to the wax-long chain polymerizable monomer dispersion to obtain a wax-partial polymer dispersion.

In the case of polymerizing the wax-long chain polymerizable monomer dispersion, the initiator or the polymerization conditions are not limited and may be set so that the long chain polymerizable monomer will be polymerized and the polymerization can be carried out under conditions similar to emulsion polymerization which will be described hereinafter.

The process for producing a toner for developing an electrostatic charge image of the present invention is an emulsion polymerization flocculation method. By the emulsion polymerization flocculation method it is possible to obtain a particle size distribution which can not be attained by the melt-kneading pulverization method and further there is a merit such that it is possible to suitably control the degree of circularity of the toner which can not be attained by the suspension polymerization method.

Now, emulsion polymerization flocculation method suitable for the process for producing a toner for developing an electrostatic charge image of the present invention, will be described in detail.

In the present invention, the emulsion polymerization flocculation method means a production method having a step of producing primary particles of a polymer by an emulsion polymerization method and flocculating particles containing at least the primary particles of the polymer. And, it is usually one having a polymerization step, a mixing step, a flocculation step, an aging step and a cleaning and drying step.

Namely, to a dispersion containing primary particles of a polymer obtained by emulsion polymerization a colorant and, if necessary, dispersions of the respective particles of an electrification-controlling agent, wax, etc. are mixed; primary particles in such a dispersion are flocculated to form agglomerates of particles having a volume average particle diameter of from about 3 to 8 μm; if necessary, fine particles of a resin, etc. are deposited thereon; such agglomerates of particles are fused; and toner particles thus obtained are washed and dried to obtain a toner.

As wax to be used for the emulsion polymerization flocculation method, one prepared as the above-mentioned wax-long chain polymerizable monomer dispersion is employed but such wax may be employed in combination with wax not prepared as a wax-long chain polymerizable monomer dispersion.

In the production by the emulsion polymerization flocculation method, the above wax-long chain polymerizable monomer dispersion may be used as polymerized or not polymerized, but preferably used as not polymerized. In the case of emulsion polymerization, the emulsified dispersed particle size of the monomer to constitute primary particles of a polymer is extremely small as compared with the dispersed particle size in suspension polymerization, and accordingly, even in a case where the monomer is impregnated in the wax-long is chain polymerizable monomer dispersion, the wax can maintain the small particle size (fine dispersion). Further, the affinity between the wax and the resin constituting the primary particles of a polymer will also be good, whereby wax can be incorporated in a large amount.

Further, it is also preferred to employ a wax-partial polymer dispersion. In emulsion polymerization, even if a wax-partial polymer dispersion is employed, wax will be sufficiently finely dispersed, and the monomer remaining in the wax-partial polymer dispersion will be polymerized together with the monomer for emulsion polymerization, whereby the affinity between the wax and the resin constituting the primary particles of the polymer can be improved.

In the emulsion polymerization flocculation method, a wax-polymer dispersion may also be employed. In the case of employing the wax-polymer dispersion it is preferred to add it in the flocculation step which will be described hereinafter. When such a wax-polymer dispersion is employed in the flocculation step, dispersion of wax in the toner can be made fine as compared with a case where wax is by itself used in the flocculation step, whereby it becomes possible to incorporate wax in a larger amount.

As the emulsifying agent to be used for emulsion polymerization in the present invention, a known product is may be employed, and at least one emulsifying agent selected from cationic surfactants, anionic surfactants and nonionic surfactants may be used.

Specifically, the cationic surfactants may, for example, be dodecylammonium chloride, dodecylammonium bromide, dodecyltrimethylammonium bromide, dodecylpyridinium chloride, dodecylpyridinium bromide and hexadecyltrimethylammonium bromide.

Further, specifically, the anionic surfactants may, for example, be a fatty acid soap such as sodium stearate or sodium dodecanoate, and an alkali metal salt of a linear alkylbenzenesulfonic acid such as sodium dodecylsulfate, sodium dodecylbenzenesulfonate or sodium laurylsulfate.

Further, specifically, the nonionic surfactants may, for example, be polyoxyethylene dodecyl ether, polyoxyethylene hexadecyl ether, polyoxyethylene nonyl phenyl ether, polyoxyethylene lauryl ether, polyoxyethylene sorbitan monooleate ether and monodecanoyl sucrose. Among such surfactants, an alkali metal salt of a linear alkylbenzenesulfonic acid is preferred.

The amount of the emulsifying agent is usually from 0.1 to 10 parts by weight of the polymerizable monomer. Further, to such an emulsifying agent, one or more polyvinyl alcohols such as partially or completely saponified polyvinyl alcohols, or cellulose derivatives such as hydroxyethyl cellulose, may be used in combination as a protective colloid.

The primary particles of the polymer to be used for the emulsion polymerization flocculation method preferably have a glass transition temperature (Tg) of from 40 to 80° C. and an average particle diameter of usually from 0.02 to 3 μm. Such primary particles of the polymer are obtained by emulsion-polymerizing a monomer.

At the time of emulsion polymerization, it is preferred to use a monomer having a Brønsted acidic group or a monomer having a Brønsted basic group, and a monomer having neither Brønsted acidic group nor Brønsted basic group, in combination. These monomers are gradually added for polymerization. At that time, the monomers may separately be added, or a plurality of monomers may be preliminarily mixed and simultaneously added. Further, during the addition of the monomers, the monomer composition may be changed. Further, the monomers may be added as they are, or they may be added in the form of a dispersion preliminarily prepared by mixing with water, an emulsifying agent, etc. As the emulsifying agent, one or a combination of two or more is selected for use among the above-mentioned surfactants.

As a polymerization initiator, one or more of hydrogen peroxide; persulfates such as potassium persulfate, sodium persulfate and ammonium persulfate, and a redox initiator having such a persulfate as one component combined with a reducing agent such as acidic sodium sulfite; water-soluble polymer initiators such as 4,4'-azobiscyanovaleric acid, t-butyl hydroperoxide and cumene hydroperoxide, and a redox initiator having such a water-soluble polymerization initiator as one component combined with a reducing agent such as a ferrous salt; azo compounds such as 2,2'-azobisisobutyronitrile, 2,2'-azobis-2,4-dimethylvaleronitrile, 1,1-azobis(cyclohexane-1-carbonitrile, and 2,2'-azobis-4-methoxy-2,4-dimethylvaleronitrile; and organic peroxides, such as peroxide type initiators such as acetylcyclohexylsulfonyl peroxide, diisopropylperoxycarbonate, decanoyl peroxide, lauroyl peroxide, stearoyl peroxide, propionyl peroxide, acetyl peroxide, t-butyl peroxy-2-ethyl hexanoate, benzoyl peroxide, t-butylperoxyisobutylate, cyclohexanone peroxide, methyl ethyl ketone peroxide, dicumyl peroxide, t-butyl hydroperoxide, di-t-butyl peroxide and cumene peroxide, may, for example, be used usually in an amount of from 0.1 to 3 parts by weight per 100 parts by weight of the polymerizable monomer. Among them, as the initiator, hydrogen peroxide, an organic peroxide or an azo compound is preferred. Such a polymerizable initiator may be added to the polymerization system at any time, i.e. before, during or after the addition of the monomer, and if necessary, these methods for addition may be used in combination.

At the time of emulsion polymerization, a known chain transfer agent may be used as the case requires. Specific examples of such a chain transfer agent include t-dodecyl mercaptan, 2-mercaptoethanol, diisopropylxanthogene, carbon tetrachloride and trichlorobromomethane. Such chain transfer agents may be used alone or in combination as a mixture of two or more of them. Such a chain transfer agent is employed usually within a range of at most 5 wt %, based on the entire monomers.

In the emulsion polymerization, the monomers are mixed with water and polymerized in the presence of the polymerization initiator. The polymerization temperature is usually from 40 to 150° C., preferably from 50 to 120° C., more preferably from 60 to 100° C.

In the emulsion polymerization, addition of the monomers to the wax-long chain polymerizable monomer dispersion may be addition all at once, continuous addition or intermittent addition, but from the viewpoint of control of the reaction, continuous addition is preferred. Further, in a case where a plurality of monomers are to be used, the respective monomers may separately be added, or the plurality of monomers may be preliminarily mixed and simultaneously added. Further, during the addition of the monomers, the monomer composition may be changed. Further, the addition of an emulsifying agent to the wax-long chain polymerizable monomer dispersion may also be addition all at once, continuous addition or intermittent addition. Further, to the wax-long chain polymerizable monomer dispersion, in addition to the above-mentioned emulsifying agent and the above-mentioned polymerizable initiator a pH-controlling agent, a polymerization degree-controlling agent, a defoaming agent, etc may optionally be added.

Otherwise, a dispersion containing the monomers, the emulsifying agent, the polymerization initiator etc., may be separately prepared and such a dispersion may be added to the wax-long chain polymerizable monomer dispersion in the case of preparing such a dispersion the average particle size of the dispersion is usually made larger than the average particle size of the wax-long chain polymerizable monomer dispersion and is preferably at least 5 μm, more preferably at least 10 μm. Further, the monomers, the emulsifying agent, the polymerization initiator, etc. may be respectively separately or in optional combinations dispersed in aqueous media, and such dispersions may be added to the wax-long chain polymerizable monomer dispersion.

Otherwise, to the dispersions thus prepared, the wax-long chain polymerizable monomer dispersion may be added.

The volume average particle diameter of primary particles of the polymer thus obtained is usually within a range of from 0.02 μm to 3 μm, preferably from 0.02 μm to 3 μm, further preferably from 0.05 μm to 3 μm, particularly preferably from 0.1 μm to 1.5 μm. If the particle diameter is smaller than 0.02 μm, control of the flocculation speed tends to be difficult, such being undesirable. On the other hand, if it is larger than 3 μm, the particle diameter of the toner obtainable by flocculation tends to too large, such being not suitable for the production of a toner of from 3 to 8 μm. Here, the volume average particle diameter may be measured, for example, by using Microtrac UPA, manufactured by Nikkiso Co., Ltd.

In the emulsion polymerization, the above monomers are polymerized in the presence of the polymerization initiator, and the polymerization temperature is usually from 50 to 120° C., preferably from 60 to 100° C., more preferably from 70 to 90° C.

As the primary particles of the polymer in the present invention, a plurality of different primary particles of polymers obtained as described above may be used in combination. Further, in the process of the present invention, a resin obtained by a polymerization method different from emulsion polymerization may be used as primary particles of a polymer, and also with respect to such a resin, it is preferred to employ one having a volume average particle diameter of usually at least 0.02 μm, preferably at least 0.05 μm, more preferably at least 0.1 μm and usually at most 3 μm, preferably at most 2 μm, is more preferably at most 1 μm.

In the emulsion polymerization flocculation method, a dispersion of primary particles of the polymer and colorant particles are mixed to obtain a mixed dispersion, which is then flocculated to obtain agglomerates of particles. The colorant is preferably employed in a state of an emulsion as emulsified in water in the presence of an emulsifying agent (the above-mentioned surfactant), and the volume average particle diameter of the colorant particles is preferably from 0.01 to 3 μm, more preferably from 0.05 μm to 3 μm, particularly preferably from 0.1 μm to 3.0 μm.

The amount of the colorant is usually from 1 to 25 parts by weight, preferably from 1 to 15 parts by weight, more preferably from 3 to 12 parts by weight, per 100 parts by weight of the primary particles of the polymer.

As a method for incorporating an electrification-controlling agent in the emulsion polymerization flocculation method at the time of obtaining primary particles of the polymer, the electrification-controlling agent may be used as seeds together with wax the electrification-controlling agent may be used as dissolved or dispersed in the monomers or wax, at the same time as the primary particles of the polymer and the colorant; the primary particles of the electrification-controlling agent are flocculated to form agglomerates of particles, or the primary particles of the polymer and the colorant are flocculated to a particle size substantially suitable as a toner, whereupon the electrification-controlling agent may be added, followed by flocculation.

In such a case, it is preferred to disperse also the electrification-controlling agent in water by means of the emulsifying agent (the above-mentioned surfactant) and use it in the form of an emulsion (primary particles of the electrification-controlling agent) having an average particle diameter of from 0.01 to 3 μm, more preferably from 0.05 to 3 μm, particularly preferably from 0.1 to 3.0 μm.

Mixing Step

In the flocculation step in the process of the present invention, the above-mentioned blend components such as the primary particles of the polymer, the colorant particles, the optional electrification-controlling agent and wax, may be mixed simultaneously or sequentially. However, it is preferred to preliminarily prepare dispersions of the respective components, i.e. a dispersion of the primary particles of the polymer, a dispersion of the particles of the colorant, an optional dispersion of the electrification-controlling agent and an optional dispersion of fine particles of wax and mix them to obtain a mixed dispersion.

Further, wax is preferably one internally included in the primary particles of the polymer, i.e. it is preferred to incorporate wax into the toner by using the primary particles of the polymer emulsion-polymerized by using wax as seeds. In such a case, wax internally included in the primary particles of the polymer and fine particles of wax not so included may be used in combination. More preferably, substantially all amount of wax is used in the form internally included in the primary particles of the polymer.

Flocculation Step

The above mixed dispersion of various particles is flocculated to form agglomerates of particles in the flocculation step. Such a flocculation step may, for example, be carried out by 1) a method of carrying out flocculation by heating, 2) a method of carrying out flocculation by adding an electrolyte, and 3) a method of carrying flocculation by adjusting the pH.

In a case where the flocculation is carried out by heating, the flocculation temperature is specifically within a temperature range of from 40° C. to Tg+10° C. (where Tg is the glass transition temperature of the primary particles of the polymer), preferably within a range of from Tg−10° C. to Tg+5° C., more preferably within a range of from Tg−10° C. to Tg. Within the above temperature range, the dispersion can be flocculated to the desired toner particle size without using an electrolyte.

Further, when the flocculation is carried out by heating, the flocculation step may be followed by an aging step, and in such a case, the flocculation step and the aging step are continuously carried out, so that the boundary may not be distinct. However, if there is a step wherein the temperature is maintained within a range of from Tg−20° C. to Tg for at least 30 minutes, such a step is regarded as the flocculation step.

It is preferred to obtain toner particles having a desired particle diameter by maintaining the flocculation temperature at the prescribed temperature for at least 30 minutes. To the prescribed temperature, the temperature may be raised at a constant rate or stepwisely. The retention time is preferably at least 30 minutes and at most 3 hours more preferably at least 1 hour and at most 4 hours, within a range of from Tg−20° C. to Tg. It is thereby possible to obtain a toner having a small particle diameter and a sharp particle size distribution.

Further, in a case where flocculation is carried out by adding an electrolyte to the mixed dispersion, the electrolyte may be an organic salt or an inorganic salt. However, a monovalent or at least bivalent metal salt is preferably employed. Specifically, NaCl, KCl, LiCl. $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)$, $CH_3COONa$ or $C_6H_5SO_3Na$ may, for example, be mentioned. Among them, an inorganic salt having at least bivalent metal cation, is preferred.

The amount of the electrolyte varies depending upon the type of the electrolyte, but it is usually from 0.05 to 25 parts by weight, preferably from 0.05 to 15 parts by weight, more preferably from 0.1 to 10 parts by weight, per 100 parts by weight of the solid component in the mixed dispersion.

If the amount of the electrolyte is substantially smaller than the above range, the progress of the flocculation reaction tends to be slow, and there may be a case where a problem will result such that a fine powder of at most 1 μm will remain even after the flocculation reaction, or the average particle diameter of the obtained agglomerates of particles tends to be at most 3 μm. On the other hand, if the amount of the electrolyte is substantially larger than the above range, flocculation tends to be rapid and difficult to control, and there may be a problem such that coarse particles of 25 μm or larger will be contained in the agglomerates of particles thereby obtained, or the shape of agglomerates tends to be deformed or irregular.

Further, in a case where flocculation is carried out by adding an electrolyte to the mixed dispersion, the flocculation temperature is preferably within a temperature range of from 5° C. to Tg.

Other Blend Components

In the present invention, on the surface of the agglomerates of particles after the above flocculation treatment, fine particles of a resin are preferably coated (deposited or fixed) to form toner particles.

In a case where the above-described electrification-controlling agent is to be added after the flocculation treatment, fine particles of a resin may be added after adding the electrification-controlling agent to the dispersion containing agglomerates of particles.

As the fine particles of a resin, it is possible to employ, for example, ones having a volume average particle diameter of preferably from 0.02 to 3 μm, more preferably from 0.05 to 1.5 μm, particularly preferably from 0.05 to 1.0 μm and obtained by polymerizing a monomer similar to the monomer to be employed for the above-mentioned primary particles of the polymer. Further, in such fine particles, wax may be contained by a method such as seed polymerization at the time of producing such fine particles of a resin and other than wax, various materials may be contained for the purpose of modifying the surface property. In a case where the agglomerates of particles are coated with fine particles of a resin to form a toner, the resin to be used for fine particles of resin is preferably one which is crosslinked.

Aging Step

In the emulsion polymerization flocculation method, it is preferred to add an aging step to induce fusion among the flocculated particles within a range of from Tg+20° C. to Tg+80° C. (where Tg is the glass transition temperature of the primary particles of the polymer) in order to increase the stability of the agglomerates of particles (toner particles) obtained by the flocculation. A range of from Tg+20° C. to Tg+70° C. is further preferred, and a range of from Tg+20° C. to Tg+60° C. is particularly preferred. Further, in this aging step, it is preferred that the temperature is maintained within the above temperature range for at least 1 hour. By adding such an aging step, it is possible to make the shape of the toner particles close to spherical, and it becomes possible to control the shape. Such an aging step is usually preferably from 0.1 hour to 10 hours, more preferably from 0.1 hour to 5 hours, further preferably from 0.1 hour to 3 hours.

The agglomerates of particles before the aging step are considered to be agglomerates formed by electrostatic or another physical flocculation of primary particles, but after the aging step, the primary particles of the polymer constituting the agglomerates of particles are fused one another to form substantially a spherical shape. By such a process for producing a toner, it is possible to produce toners having various shapes (spherical degrees) depending upon the particular purposes, such as a grape type of shape wherein the primary particles are flocculated, a potato type wherein the fusion is advanced to a halfway and a spherical shape wherein the fusion is further advanced. Further, in a case where flocculation is carried out in multistages as mentioned above, it is also possible to carry out a flocculation step again after the aging step. Also in such a case, it is preferred to carry out the aging step again.

Cleaning/Drying Step

The agglomerates of particles obtained via the above-described various steps, are subjected to solid/liquid separation in accordance with a known method to recover the agglomerates of particles which are then washed and dried, as the case requires, to obtain the desired toner particles.

In such a manner it is possible to produce a toner having a relatively small particle size i.e. a volume average particle diameter of from 3 to 8 μm. Yet, the toner obtained in such a manner has a sharp particle size distribution and is one suitable as a toner for developing an electrostatic charge image to accomplish a high image quality and high speed. Here, the particle diameter of the toner host particles is a value measured by using a Multisizer (manufactured by Coulter).

To the toner in the present invention, a known auxiliary agent may be added to control the fluidity or the developing property. As such an auxiliary agent, various inorganic oxide particles of e.g. silica, alumina or titania (if necessary, subjected to hydrophobic treatment) or vinyl polymer particles may, for example, be used, and they may be used in combination. The amount of the auxiliary agent is preferably from 0.05 to 5 parts by weight, based on the toner particles. The method of adding the auxiliary agent to the toner is not limited, and a mixing machine commonly employed for the production of a toner may be used, and for example, it can be carried out by uniformly mixing and stirring by a mixing machine such as a Henschel mixer, a V-type blender or a Loedige Mixer.

The toner for developing an electrostatic charge image thus obtained by the process of the present invention has a volume average particle diameter (Dv) of usually from 3 to 8 μm, preferably from 4 to 8 μm, more preferably from 4 to 7 μm. If the volume average particle diameter is too large, such is not suitable for forming an image with a high resolution, and if it is too small, it tends to be difficult to handle as a powder. Here, as a method for measuring the particle diameter of the toner, a commercially available particle size measuring apparatus may be employed, but typically, a precise particle size distribution measuring device Coulter Counter, Multisizer II, manufactured by Beckman Coulter, Inc, may be employed.

With respect to the circularity of the toner, one having an average circularity of from 0.9 to 1.0 is preferred, and the circularity is more preferably from 0.93 to 0.98, particularly preferably from 0.94 to 0.98. Here, the average circularity corresponds to an average circularity obtained by measuring the toner typically by a flow type particle image analyzer FPIA-2000 manufactured by Sysmex and using the formula (circularity=peripheral length of a circle having the same area as the particle projected area/peripheral length of particle projected image). If the circularity is less than the above range, the transfer efficiency tends to be poor, and the dot reproducibility tends to be low, and if it exceeds the above range, a non-transferred toner remaining on the photoreceptor tends to be not completely scraped off by a blade and tends to cause an image defect.

The toner for developing an electrostatic charge image of the present invention preferably has a relation between the volume average particle diameter (Dv) and the number average particle diameter (Dn) being 1.0≦Dv/Dn≦1.3, more preferably 1.0≦Dv/Dn≦1.2, particularly preferably 1.0≦Dv/Dn≦1.1. The lower limit of Dv/Dn is 1, and this means that all particle diameters are equal. To accomplish such a particle size distribution, it is particularly preferred to carry out the production by an emulsion polymerization flocculation method. A toner having a sharp particle size distribution is advantageous to form a highly fine image, since the colorant, the electrification-controlling agent, etc. tend to be uniformly distributed to provide uniform electrification. Here, the measurement of the number average particle diameter (Dn) is carried out in the same manner as for Dv.

Further, the toner preferably contains a less amount of fine particles (fine powder). In a case where fine particles are less, the flowability of the toner tends to be improved, and the colorant, the electrification-controlling agent, etc. will be uniformly distributed to provide a uniform electrification. As the toner for developing an electrostatic charge image to be obtained by the process of the present invention, it is preferred to employ a toner wherein the measured value (the number) of particles of from 0.6 μm to 2.12 μm by a flow type particle image analyzer is at most 15% of the total number of particles. This means that fine particles are less than a certain amount. The number of particles of from 0.6 μm to 2.12 μm is more preferably at most 10%, particularly preferably at most 5%. Further, there is no lower limit for the fine particles, and most preferably there is no such fine particles. However, such is practically not attainable, and such fine particles are usually at least 0.5%, preferably at least 1%. For the measurement of the fine particles, for example, a flow type particle image analyzer FPIA-2000, manufactured by Sysmex is suitably employed.

The toner by the present invention may be applied to any of a two component developer, a magnetic one component developer such as a magnetite-containing toner and a non-magnetic one component developer.

When it is used as a two component developer, as the carrier to be mixed with the toner to form a developer, a known magnetic material such as a iron-powder type, ferrite-type or magnetite-type carrier or one having a resin coating applied to the surface of such a magnetic material, or a magnetic resin carrier, may be employed.

As the coating resin for the carrier, a commonly known styrene resin, acrylic resin, styrene/acrylic copolymer resin silicone resin modified silicone resin or fluorine resin may, for example, be employed, but it s not limited thereto. The average particle diameter of the carrier is not particularly limited but it is preferably one having an average particle diameter of from 10 to 200 μm. Such a carrier is preferably used in an amount of from 5 to 100 parts by weight per part by weight of the toner.

As described in the foregoing according to the process for producing a toner for developing an electrostatic charge image of the present invention, it is possible to efficiently produce a toner for developing an electrostatic charge image excellent in the image o characteristics without deteriorating any other various characteristics and being free from blocking during the storage or from soiling of the image-forming device, and thus, the value of its industrial application is very high.

EXAMPLES

Now, the present invention will be described in further detail with reference to Examples, but the present invention is by no means restricted to the following Examples.

In the following Examples, "parts" means "parts by weight". Further, the practical printing test was carried out by the following method.

Example 1

Preparation of Wax-Long Chain Polymerizable Monomer Dispersion A1

27 Parts of paraffin wax (HNP-09 manufactured by Nippon Seiro Co., Ltd.), 2.8 parts of stearyl acrylate (manufactured by Tokyo Kasei), 2.8 parts of a 20% anionic surfactant aqueous solution (NEOGEN S20A, manufactured by Dai-ichi Kogyo Seiyaku Co, Ltd.) and 67.2 parts of deionized water were heated to 90° C. and stirred for 10 minutes by a disperser. Then, this dispersion was heated to 100° C., then emulsification was initiated under a pressure condition of about 15 MPa by means of a homogenizer (15-M-8PA model, manufactured by Gaulin) and while measuring by a particle size distribution meter, it was dispersed to a volume average particle diameter of 200 nm to prepare a wax-long chain polymerizable monomer dispersion A1 (solid content concentration of the emulsion=30%).

Preparation of Silicon Wax Dispersion A2

27 Parts of an alkyl-modified silicone wax having the following structure (1), 0.46 part of a 65.8% anionic surfactant aqueous solution (NEOGEN SC, manufactured by Dai-ichi Kogyo Seiyaku Co., Ltd.) and 72.54 parts of deionized water were heated to 90° C. and stirred for 10 minutes by a disperser. Then, this dispersion was heated to 100° C., then emulsification was initiated under a pressure condition of about 15 MPa by means of a homogenizer 15-M-8PA model manufactured by Gaulin), and while measuring by a particle size distribution meter, it was dispersed until the volume average particle diameter became 200 nm to prepare a silicone wax dispersion A2.

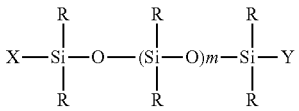

(1)

(In the formula (1), R=a methyl group, m=10, X=Y=an alkyl group having an average carbon number of 30.)

Preparation of Polymer Primary Particle Dispersion A1

Into a reactor equipped with a stirring device (three vanes), a heating/cooling device, a concentrating device and a device for charging various raw materials and additives, 35.6 parts by weight of the wax-long chain polymerizable monomer dispersion A1 and 259 parts of deionized water were charged and heated to 90° C. in a nitrogen stream with stirring.

Thereafter, while stirring was continued, a mixture of the following monomers and aqueous emulsifier solution was added over a period of 5 hours from the initiator of is the polymerization, and the following aqueous initiator solution was added over a period of 5 hours from the initiation of the polymerization. Further, after 5 hours from the initiation of the polymerization; the following aqueous additional initiator solution was added over a period of 2 hours, and the polymerization system was maintained for further 1 hour. As an emulsifier, one having NEOGEN SC being a 65.8% sodium dodecylbenzenesulfonate aqueous solution manufactured by Dai-ichi Kogyo Seiyaku Co., Ltd. diluted by deionized water to 20%, was employed (hereinafter referred to as a 20% DES aqueous solution).

Monomers:

| | |
|---|---|
| Styrene | 76.8 parts |
| Butyl acrylate | 23.2 parts |
| Acrylic acid | 1.5 parts |
| Tetrachlorobromomethane | 1.0 part |
| Hexanediol diacrylate | 0.7 part |

Aqueous Emulsifier Solution:

| | |
|---|---|
| 20% DBS aqueous solution | 1.0 part |
| Deionized water | 67.1 parts |

Aqueous Initiator Solution:

| | |
|---|---|
| 8% hydrogen peroxide aqueous solution | 15.5 parts |
| 8% L(+)-ascorbic acid aqueous solution | 15.5 parts |

Aqueous Additional Initiator Solution:

| | |
|---|---|
| 8% L(+)-ascorbic acid aqueous solution | 14.2 parts |

After completion of the polymerization reaction, the reaction system was cooled to obtain a milky white polymer primary particle dispersion A1. The volume average particle diameter measured by Microtrac UPA was 200 nm.

Preparation of Polymer Primary Particle Dispersion A2

Into a reactor equipped with a stirring device (three vanes), a heating/cooling device, a concentrating device and a device for charging various raw materials and additives, 23.7 parts of the wax silicone dispersion A2, 1.5 parts of the 20% DES aqueous solution and 326 parts of deionized water were charged and heated to 90° C. in a nitrogen stream, and 3.2 parts of a 8% hydrogen peroxide aqueous solution, and 3.2 parts of a 8% L(+)-ascorbic acid aqueous solution were added.

Thereafter, a mixture of the following monomers and aqueous emulsifier solution was added over a period of 5 hours from the initiation of the polymerization, the following aqueous initiator solution was added over a period of 5 hours from the initiation of the polymerization, and further, after 5 hours from the initiation of the polymerization, the following aqueous additional initiator solution was added over a period of 2 hours, and the polymerization system was maintained for further 1 hour.

Monomers:

| | |
|---|---|
| Styrene | 92.5 parts |
| Butyl acrylate | 7.5 parts |
| Acrylic acid | 1.5 parts |
| Tetrachlorobromomethane | 0.6 part |

Aqueous Emulsifier Solution:

| | |
|---|---|
| 20% DBS aqueous solution | 1.5 parts |
| Deionized water | 66.2 parts |

Aqueous Initiator Solution:

| | |
|---|---|
| 8% hydrogen perioxide aqueous solution | 15.5 parts |
| 8% L(+)-ascorbic acid aqueous solution | 15.5 parts |

Aqueous Additional Initiator Solution:

| | |
|---|---|
| 8% L(+)-ascorbic acid aqueous solution | 14.2 parts |

After completion of the polymerization reaction, the reaction system was cooled to obtain a milky white polymer primary particle dispersion A2. The volume average particle diameter measured by Microtrac UPA was 260 nm.

Preparation of Colorant Dispersion A

20 Parts of pigment yellow 155 (Novoperm Yellow 4G, manufactured by Clariant Japan), 1 part of an anionic surfactant (NEOGEN SC, manufactured by Dai-ichi Kogyo Seiyaku Co., Ltd.), 5 parts of a nonionic surfactant (NOIGEN EASO, manufactured by Dai-ichi Kogyo Seiyaku Co., Ltd.) and 80 parts of water were dispersed by a sand grinder mill to obtain a colorant dispersion A. The is volume average particle diameter of the particles measured by Microtrac UPA was 150 nm.

Production of Toner A for Development

| | |
|---|---|
| Polymer primary particle dispersion A1 | 95 parts (as solid content) |
| Polymer primary particle dispersion A2 | 5 parts (as solid content) |
| Colorant fine particle dispersion A | 6 parts (as solid content) |
| 20% DBS aqueous solution | 0.1 part (as solid content) |

Using the above respective components, a toner was produced by the following procedure.

Into a reactor (capacity: 2 liter, double helical vanes provided with a baffle), the polymer primary particle dispersion A1 and the 20% DBS aqueous solution were charged and uniformly mixed, whereupon the colorant fine particle dispersion A was added and uniformly mixed therewith. While the obtained mixed dispersion was stirred a 5% ferrous sulfate aqueous solution was added in an amount of 0.52 part as $FeSO_4.7H_2O$, and after mixing for 30 minutes, a 0.5% aluminum sulfate aqueous solution was further dropwise added (the solid content was 0.29 part, based on the resin solid content). Thereafter, the temperature was raised to 52° C. over a period of 45 minutes with stirring and then to 55° C. over a period of 95 minutes. Here, the particle diameter was measured by a coulter counter, whereby the 50% volume diameter was 6.6 μm. Then, the polymer primary particle dispersion A2 was added, and the mixture was maintained for 60 minutes. Then, the 20% DBS aqueous solution (6 parts as the solid content) was added, whereupon the temperature was raised to 92° C. over 30 minutes and maintained for 34 minutes.

Thereafter, the slurry obtained by cooling was subjected to press filtration by means of a propylene filter with an air permeability of 80 cc/min under a pressure of 0.2 MPa whereby 33 parts of a filtrate was discharged against 100 parts by weight of the slurry. Thereafter, under 0.2 MPa, cleaning was carried out by continuously adding cleaning water for 1 hour. The obtained slurry was redispersed, and the above cleaning operation was repeated to carry out a total of three times of the filtration/cleaning step. The toner particles thereby obtained were dried to obtain a toner A for development.

The change with time of the weight of the filtrate passed through the filter per unit time (hereinafter referred to as a filtration flow amount) in the above filtration/cleaning step, is shown in FIG. 1. Even after repeating the filtration/cleaning for 3 times, the filtration flow amount immediately after the initiation of the filtration was maintained to be about 0.7 g/s, which was good.

Example 2

Preparation of Colorant Dispersion B

A black colorant dispersion B was obtained in the same manner as the colorant dispersion A except that pigment yellow 155 was changed to carbon black (Mitsubishi Carbon Black MA100S, manufactured by Mitsubishi Chemical Corporation). The volume average diameter of particles measured by Microtrac UPA was 150 nm.

Production of Toner B for Development

A toner B was obtained in the same manner as in Example 1 except that instead of the colorant dispersion A, the colorant dispersion B was employed. The 50% volume diameter of particles before adding the polymer primary particle dispersion A2 was 6.8 μm.

Figure 2:
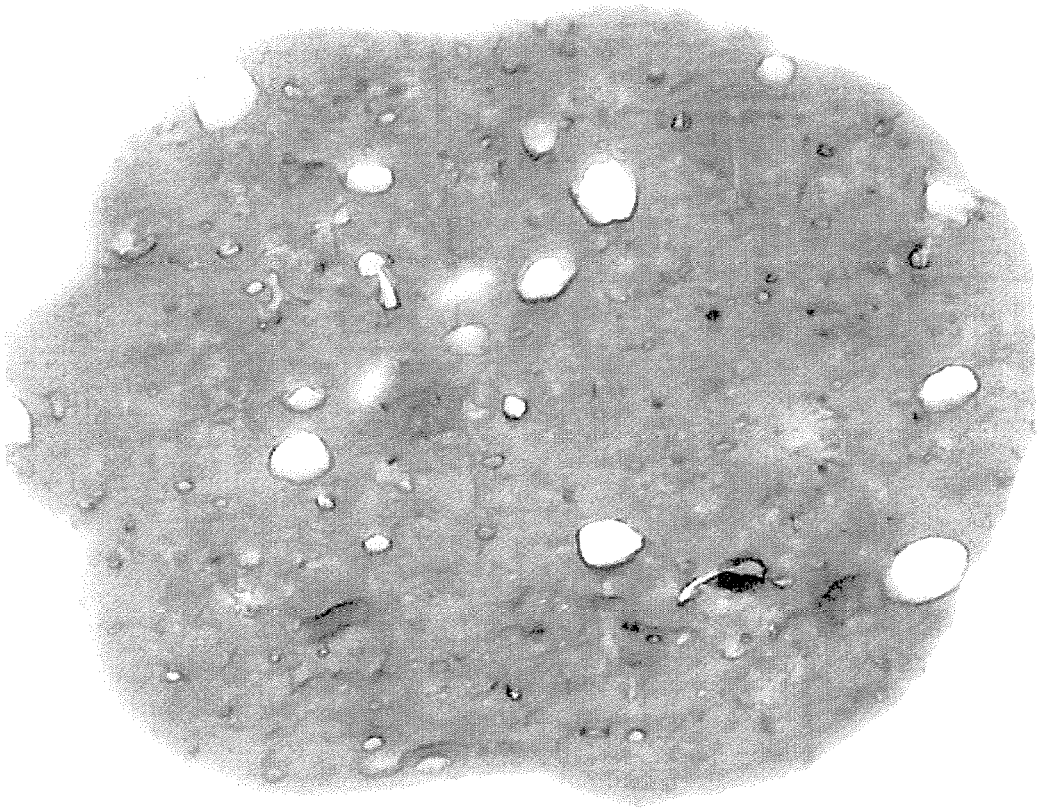
FIG. 2 is a cross-sectional TEM image of toner B for development.
Figure 3:
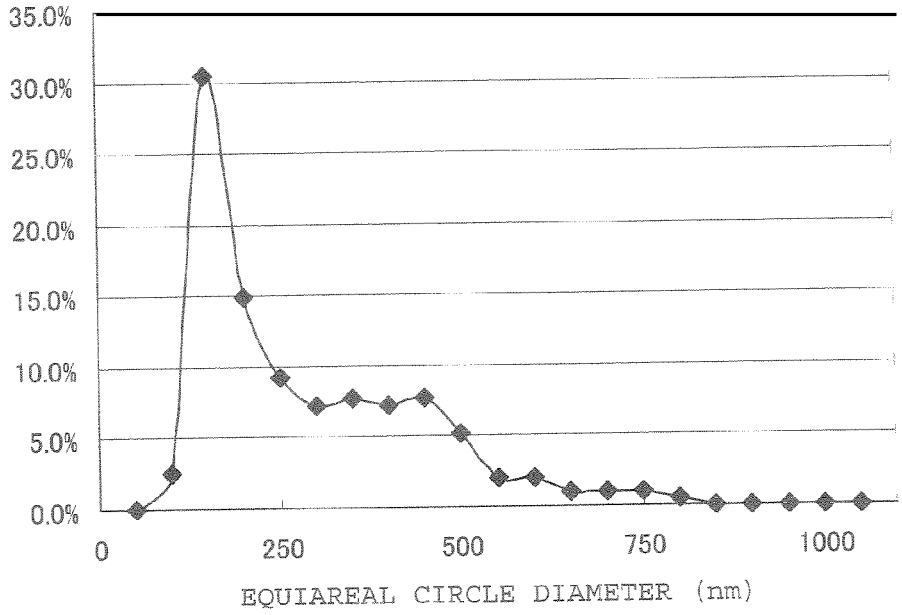
FIG. 3 is the equiareal circle diameter distribution in number of wax domains in toner B for development.

The cross-section of the toner B for development was dyed with ruthenium tetroxide and observed by a transmission electron microscope (TEM), and the results are shown in FIG. 2. By utilizing a phenomenon such that ruthenium tetroxide is deposited at the interface between the wax domain and the resin, from the TEM image, 194 wax domains were identified, and their areas were measured by the image analysis, and their equiareal circle diameter distribution was obtained, and the results are shown in FIG. 3. Leaching out of such domains on the toner surface was not observed.

Comparative Example 1

Preparation of Wax Dispersion C1

30 Parts of paraffin wax (HNP-09, manufactured by Nippon Seiro Co., Ltd.), 1.9 parts of a 20% anionic surfactant aqueous solution (NEOGEN S20A, manufactured by Daiichi Kogyo Seiyaku Co., Ltd.) and 68.5 parts of deionized water were heated to 90° C. and stirred for 10 minutes by a disperser. Then, this dispersion was heated to 100° C., and using a homogenizer (15-M-8PA model, manufactured by Gaulin), emulsifying was initiated under a pressure condition of about 15 MPa, and while measurement was carried out by a particle size distribution meter, dispersion was carried out to bring the volume average particle diameter to be 200 nm to prepare a wax dispersion C1 (emulsion solid content concentration=29%).

Preparation of Polymer Primary Particle Dispersion C1

Into a reactor equipped with a stirring device (three vanes), a heating/cooling device, a concentrating device and a device for charging various raw materials and additives, 32.2 parts by weight of the wax dispersion C1 and 255 parts of deionized water were charged and heated to 90° C. with stirring in a nitrogen stream, whereupon 3.2 parts of a 8% hydrogen peroxide aqueous solution and 3.2 parts of a 8% L(+)-ascorbic acid aqueous solution were added.

Thereafter, while stirring was continued, a mixture of the following monomers and aqueous emulsifier solution was added over a period of 5 hours from the initiation of the polymerization, the following aqueous initiator is solution was added over a period of 5 hours from the initiation of the polymerization, and further after 5 hours from the initiation of the polymerization, the following aqueous additional initiator solution was added over a period of 2 hours, and the mixture was maintained for further 1 hour. As the emulsifier, a 20% DES aqueous solution was employed.

Monomers:

| | |
|---|---|
| Styrene | 74.5 parts |
| Butyl acrylate | 25.5 parts |
| Acrylic acid | 1.5 parts |
| Tetrachlorobromomethane | 1.0 part |
| Hexanediol diacrylate | 0.8 part |

Aqueous Emulsifier Solution:

| | |
|---|---|
| 20% DBS aqueous solution | 1.0 part |
| Deionized water | 67.2 parts |

Aqueous Initiator Solution:

| | |
|---|---|
| 8% hydrogen peroxide aqueous solution | 15.5 parts |
| 8% L(+)-ascorbic acid aqueous solution | 15.5 parts |

Aqueous Additional Initiator Solution:

| | |
|---|---|
| 8% L(+)-ascorbic acid aqueous solution | 14.2 parts |

After completion of the polymerization reaction, the system was cooled to obtain a milky white polymer primary particle dispersion C1. The volume average particle diameter measured by Microtrac UPA was 190 nm.

Production of Toner C for Development

A toner C for development was obtained in the same manner as in Example 1 except that instead of the polymer primary particle dispersion A1, the polymer primary particle dispersion C1 was employed. The 50% volume diameter of particles before adding the polymer primary particle dispersion A2 was 6.7 μm.

Figure 4:
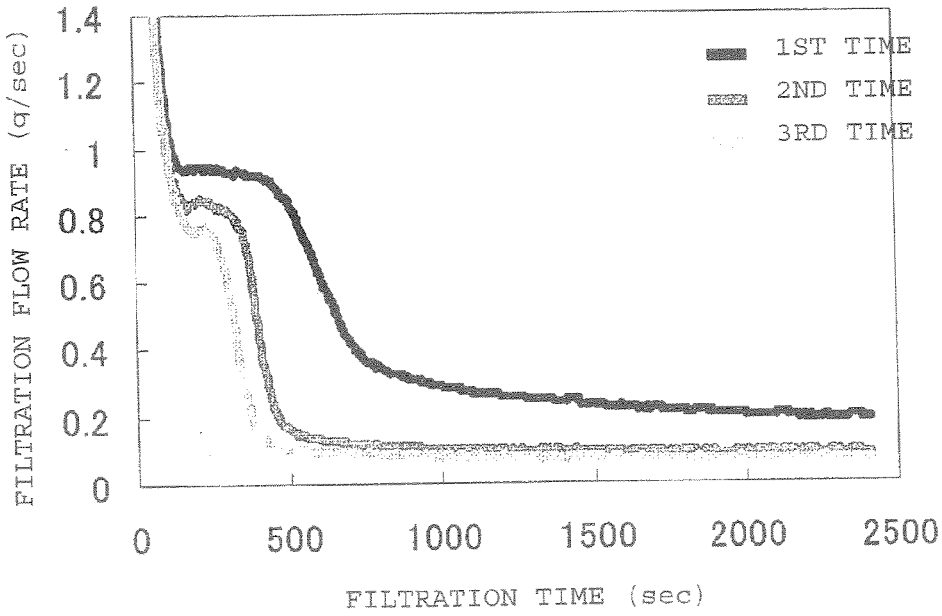
FIG. 4 shows the change with time of the filtration flow rate in a step of filtration/cleaning of toner C for development.

The change with time of the filtration flow amount in the step of filtration/cleaning three times is shown in FIG. 4. Even in the first filtration/cleaning operation, after 500 seconds from the initiation of the filtration, clogging of the filter membrane started, and a sharp decrease in the filtration flow amount was observed. Further, as the filtration/cleaning process was repeated, the filtration flow amount was immediately rapidly decreased and the value itself of the filtration flow rate became low, and thus the cleaning efficiency was extremely poor.

Comparative Example 2

Production of Toner D for Development

A toner D was obtained in the same manner as in Example 2 except that instead of the polymer primary particle dispersion A1, the polymer primary particle dispersion C1 was employed The 50% volume diameter of particles before adding the polymer primary particle dispersion A2 was 6.6 μm.

Figure 5:
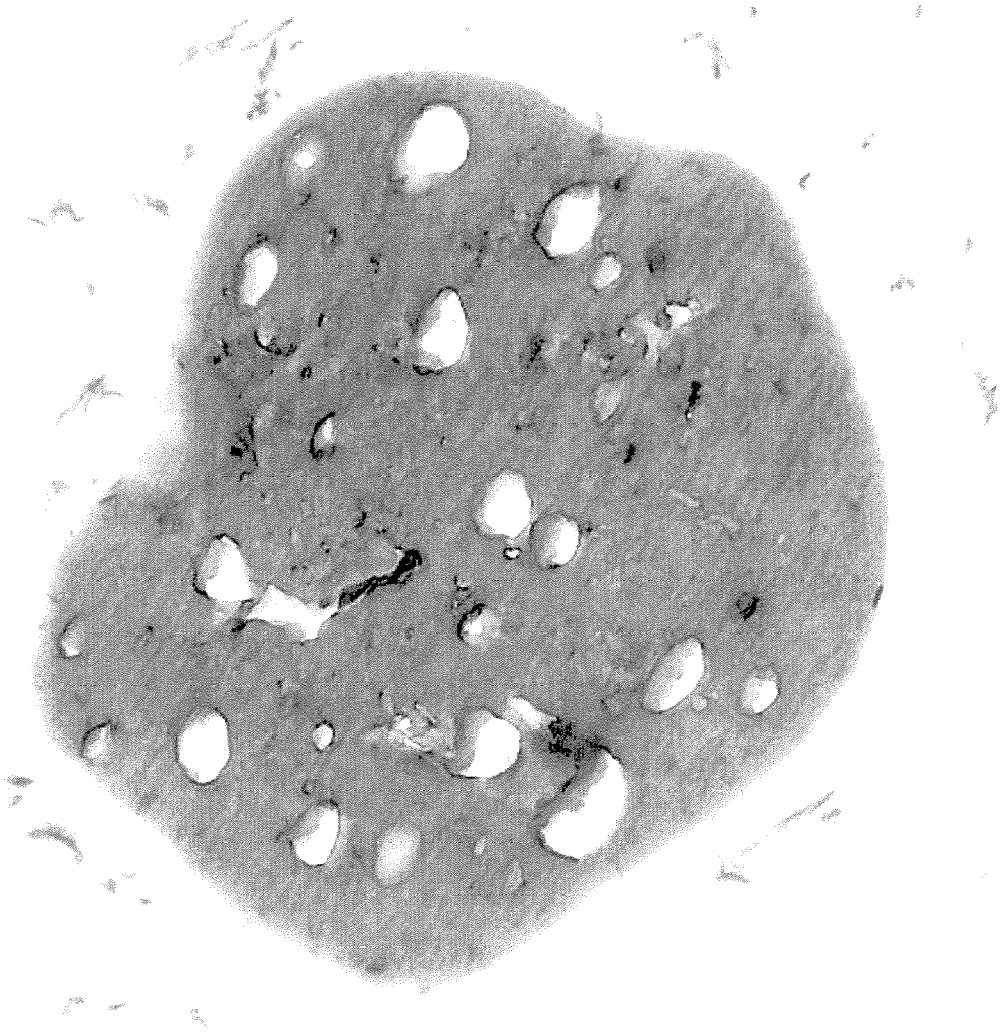
FIG. 5 is a cross-sectional TEM image of toner D for development.
Figure 6:
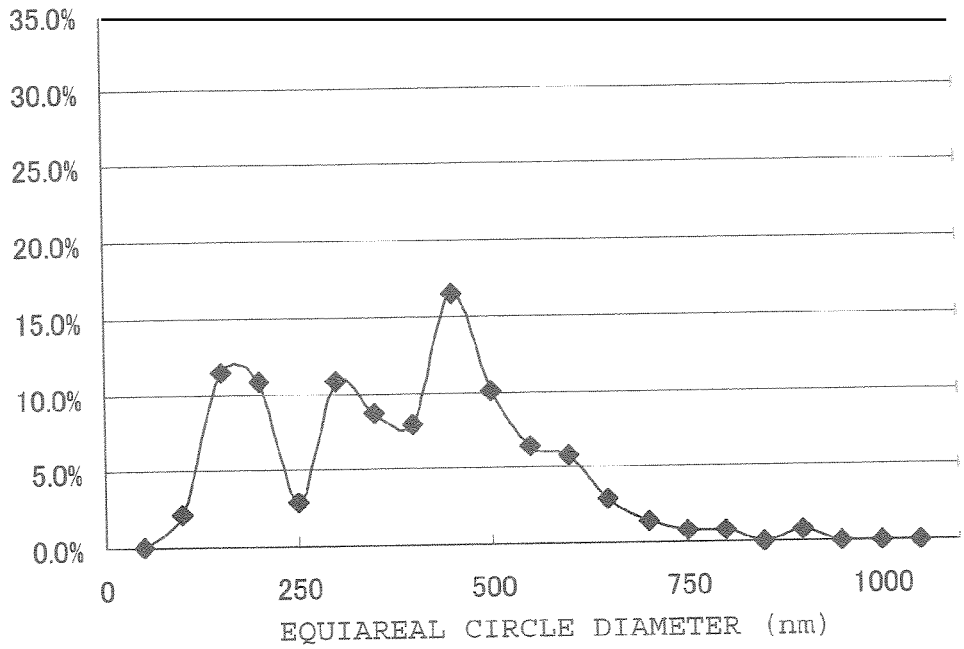
FIG. 6 is the equiareal circle diameter distribution in number of wax domains in toner D for development.

The cross-section of the toner D for development was dyed with ruthenium tetroxide and observed by a transmission electron microscope (TEM), and the results is are shown in FIG. 5. By utilizing a phenomenon such that ruthenium tetroxide was deposited at the interface between the wax domain and the resin, from the TEM image, 139 wax domains were identified, and their areas were measured by the image analysis, whereby their equiareal circle diameter distribution was obtained, and the results are shown in FIG. 6. Some of these domains were found to be leached out on the tone surface.

Comparative Example 3

Preparation of Wax Dispersion E1

30 Parts of pentaerythritol wax (UNISTER H-476, manufactured by NOF Corporation), 0.84 part of a 65.8% anionic surfactant aqueous solution (NEOGEN SC, manufactured by Dai-ichi Kogyo Seiyaku Co., Ltd.) and 69.16 parts of deionized water were heated to 90° C. and stirred for 10 minutes by a disperser. Then, this dispersion was heated to 100° C., and using a homogenizer (15-M-8PA model, manufactured by Gaulin), emulsifying was initiated under a pressure condition of about 15 MPa, and while measurement was carried out by a particle size distribution meter, dispersion was carried out to bring the volume average particle diameter to be 200 nm to prepare a wax dispersion E1 (emulsion solid content concentration=31%).

Preparation of Polymer Primary Particle Dispersion E1

Into a reactor equipped with a stirring device (three vales), a heating/cooling device, a concentrating device and a device for charging various raw materials and additives, 54.5 parts by weight of the wax dispersion E1, 3.2 parts of a 8% L(+)-ascorbic acid aqueous solution, 3.2 parts of a 8.0% hydrogen peroxide aqueous solution and 351 parts of deionized water were charged and heated to 90° C. with stirring in a nitrogen stream.

Thereafter, while stirring was continued, a mixture of the following monomers and aqueous emulsifier solution was added over a period of 5 hours, and the mixture was maintained for further 3 hours.

After completion of the polymerization reaction, the reaction system was cooled, whereby the bulk polymer was deposited on the stirring vanes or on the wall of the polymerization tank.

Monomers:

| | |
|---|---|
| Styrene | 74.0 parts |
| Stearyl acrylate | 6.0 parts |
| Butyl acrylate | 20.0 parts |
| Acrylic acid | 1.5 parts |
| Tetrachlorobromomethane | 1.0 part |
| Hexanediol diacrylate | 1.8 parts |

Aqueous Emulsifier Solution:

| | |
|---|---|
| 20% DBS aqueous solution | 2.0 parts |
| Deionized water | 66.9 parts |

Aqueous Initiator Solution:

| | |
|---|---|
| 8% hydrogen peroxide aqueous solution | 15.5 parts |
| 8% L(+)-ascorbic acid aqueous solution | 15.5 parts |

Aqueous Additional Initiator Solution:

| | |
|---|---|
| 8% hydrogen peroxide aqueous solution | 9.3 parts |
| 8% L(+)-ascorbic acid aqueous solution | 9.3 parts |

Comparative Example 4

Preparation of Wax-Long Chain Polymerization Monomer Dispersion F1

24 Parts of paraffin wax (HNP-092, manufactured by Nippon Seiro Co., Ltd.), 5.3 parts of stearyl acrylate (manufactured by Tokyo Kasei), 1.8 parts of a 20% anionic surfactant aqueous solution (NEOGEN S20A, manufactured by Dai-ichi Kogyo Seiyaku Co., Ltd.) and 68.6 parts of deionized water were heated to 90° C. and stirred for 10 minutes by a disperser. Then, this dispersion was heated to 100° C., and by using a homogenizer (15-M-8PA model, manufactured by Gaulin), emulsifying was initiated under a pressure condition of about 15 MPa, and while measurement was carried out by a particle size distribution meter, dispersion was carried out to bring the volume average particle diameter to be 200 nm to prepare a wax-long chain polymerizable monomer dispersion F1 (emulsion solid content concentration=27%).

Preparation of Polymer Primary Particle Dispersion F1

Into a reactor equipped with a stirring device (three vanes), a heating/cooling device, a concentrating device and a device for charging various raw materials and additives, 44.9 parts by weight of the wax-long chain polymerizable monomer dispersion F1 and 255 parts of deionized water were charged and heated to 90° C. with stirring in a nitrogen stream, and 3.2 parts of a 8% hydrogen peroxide aqueous solution and 3.2 parts of a 8% L(+)-ascorbic acid aqueous solution were added.

Thereafter, while stirring was continued a mixture of the following monomers and aqueous emulsifier solution was added over a period of 5 hours from the initiation of the polymerization, the following aqueous initiator solution was added over a period of 5 hours from the initiation of the polymerization, and further, after 5 hours from the initiation of the polymerization, the following aqueous additional initiator solution was added over a period of 2 hours, and the mixture was maintained for further 1 hour. As the emulsifier, a 20% DES aqueous solution was employed.

Monomers:

| | |
|---|---|
| Styrene | 74.5 parts |
| Butyl acrylate | 25.5 parts |
| Acrylic acid | 1.5 parts |
| Tetrachlorobromomethane | 1.0 part |
| Hexanediol diacrylate | 0.8 part |

Aqueous Emulsifier Solution:

| | |
|---|---|
| 20% DBS aqueous solution | 1.0 part |
| Deionized water | 67.2 parts |

Aqueous Initiator Solution:

| | |
|---|---|
| 8% hydrogen peroxide aqueous solution | 15.5 parts |
| 8% L(+)-ascorbic acid aqueous solution | 15.5 parts |

Aqueous Additional Initiator Solution:

| | |
|---|---|
| 8% L(+)-ascorbic acid aqueous solution | 14.2 parts |

After completion of the polymerization reaction, the system was cooled to obtain a milky white polymer primary particle dispersion F1. The volume average particle diameter measured by Microtrac UPA was 190 nm.

Production of Toner F for Development

A toner F for development was obtained in the same manner as in Example 1 except that instead of the polymer primary particle dispersion A1 the polymer primary particle dispersion F1 was employed. The 50% volume diameter of particles before adding the polymer primary particle dispersion A2 was 6.7 μm.

Figure 7:
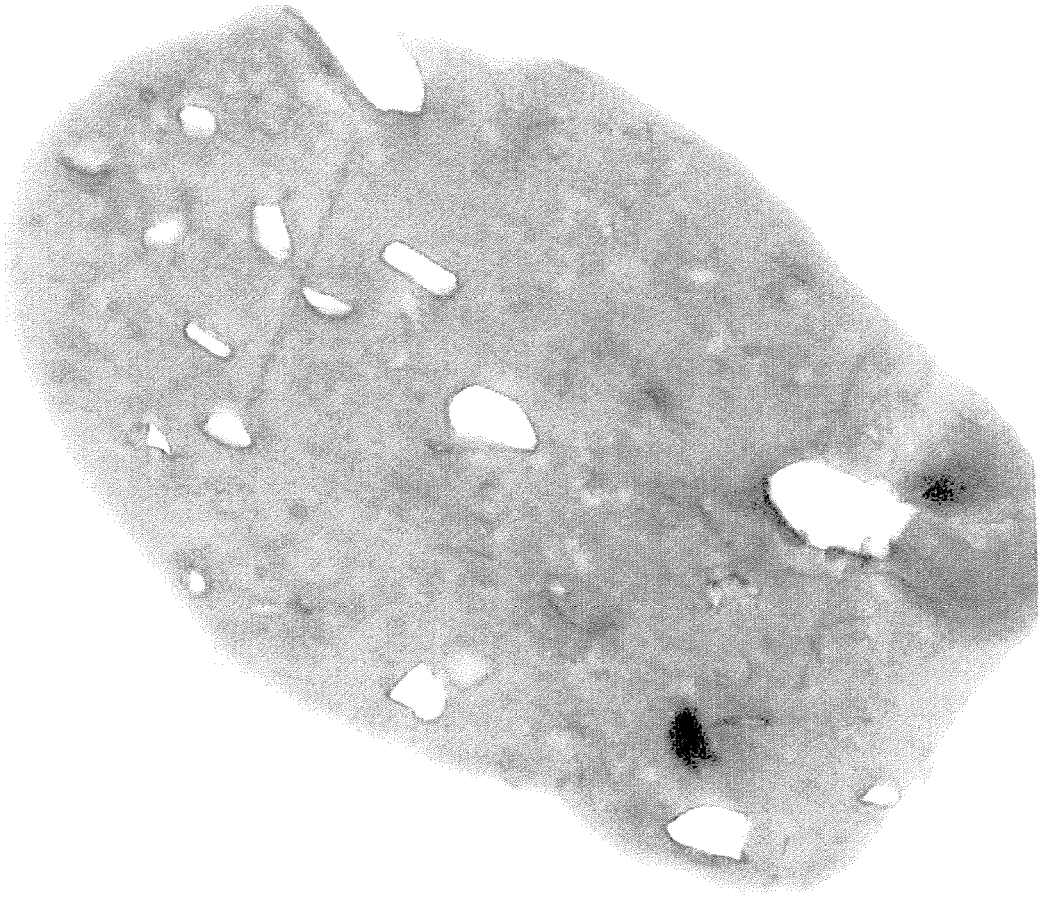
FIG. 7 is a cross-sectional TEM image of toner F for development.
Figure 8:
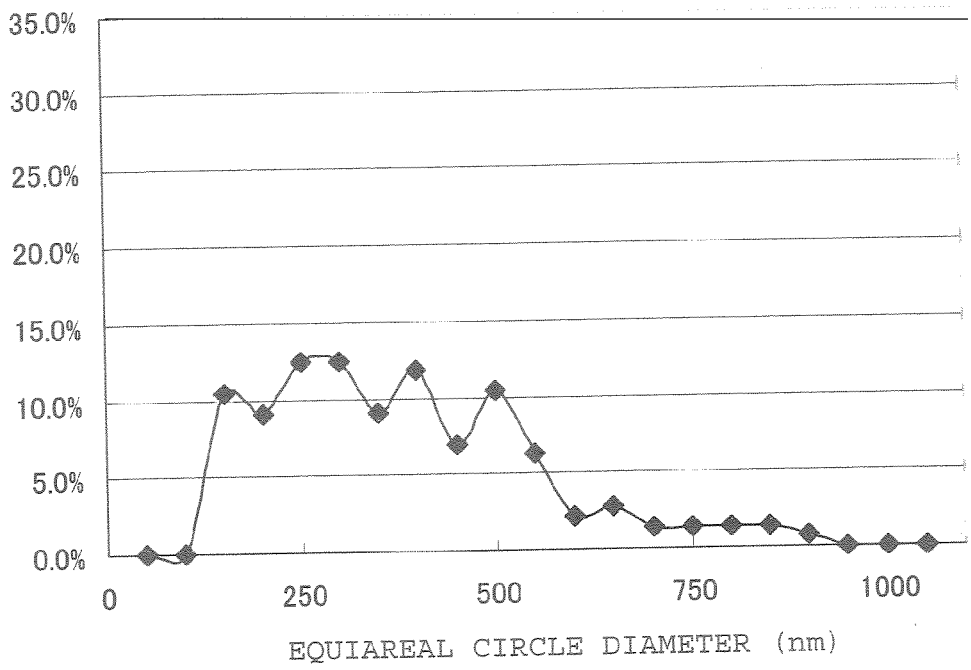
FIG. 8 is the equiareal circle diameter distribution in number of wax domains in toner F for development.

The cross-section of the toner F for development was dyed with ruthenium tetroxide and observed by a transmission electron microscope (TEM), and the results are shown in FIG. 7. By utilizing a phenomenon such that ruthenium tetroxide was deposited at the interface between the wax domain and the resin, from the TEM image, 144 wax domains were identified, and their areas were measured by the image analysis, whereby their equiareal circular diameter distribution was obtained, and the results are shown in FIG. 8. Some of these domains were found to be leached out on the toner surface.

Comparative Example 5

Preparation of Wax-Long Chain Polymerizable Monomer Dispersion G1

14.3 Parts of paraffin wax (HNP-09, manufactured by Nippon Seiro Co., Ltd), 15.5 parts of stearyl acrylate (manufactured by Tokyo Kasei), 1.1 parts of a 20% anionic surfactant aqueous solution (NEOGEN S20A, manufactured by Daiichi Kogyo Seiyaku Co., Ltd.) and 69.1 parts of deionized water were heated to 90° C. and stirred for 10 minutes by a disperser. Then, this dispersion was heated to 100° C., and by using a homogenizer (15-M-8PA model, manufactured by Gaulin) emulsifying was initiated under a pressure condition of about 15 MPa, and white measurement was carried out by a particle size distribution meter, dispersion was carried out to bring the volume average particle diameter to be 200 nm to prepare a wax-long chain polymerizable monomer dispersion G1 (emulsion solid content concentration=29%).

Preparation of Polymer Primary Particle Dispersion G1

Into a reactor equipped with a stirring device (three vanes), a heating/cooling device, a concentrating device and a device for charging various raw materials and additives, 64.7 parts by weight of the wax-long chain polymerizable monomer dispersion G1 and 265 parts of deionized water were charged and heated to 90° C. with stirring in a nitrogen stream, and 3.2 parts of a 8% hydrogen peroxide aqueous solution and 3.2 parts of a 8% L(+)-ascorbic acid aqueous solution were added.

Thereafter, while stirring was continued, a mixture of the following monomers and aqueous emulsifier solution was added over a period of 5 hours from the initiation of the polymerization, the following aqueous initiator solution was added over a period of 5 hours from the initiation of the polymerization, and further, after 5 hours from the initiation of the polymerization, the following aqueous additional initiator solution was added over a period of 2 hours, and the system was maintained for further 1 hour. As the emulsifier a 20% DES aqueous solution was employed.

Monomers:

| | |
|---|---|
| Styrene | 74.5 parts |
| Butyl acrylate | 25.5 parts |
| Acrylic acid | 1.5 parts |
| Tetrachlorobromomethane | 1.0 part |
| Hexanediol diacrylate | 0.8 part |

Aqueous Emulsifier Solution:

| | |
|---|---|
| 20% DBS aqueous solution | 1.0 part |
| Deionized water | 67.2 parts |

Aqueous Initiator Solution:

| | |
|---|---|
| 8% hydrogen peroxide aqueous solution | 15.5 parts |
| 8% L(+)-ascorbic acid aqueous solution | 15.5 parts |

Aqueous Additional Initiator Solution:

| | |
|---|---|
| 8% L(+)-ascorbic acid aqueous solution | 14.2 parts |

After completion of the polymerization, the system was cooled to obtain a milky white polymer primary particle dispersion G. The volume average particle diameter measured by Microtrac UPA was 190 nm.

Production of Toner G for Development

A toner , for development was obtained in the same manner as in Example 1 except that instead of the polymer primary particle dispersion A1, the polymer primary particle dispersion G1 was employed. The 50% volume diameter of particles before the addition of the polymer primary particle dispersion A2 was 6.7 μm.

Figure 9:
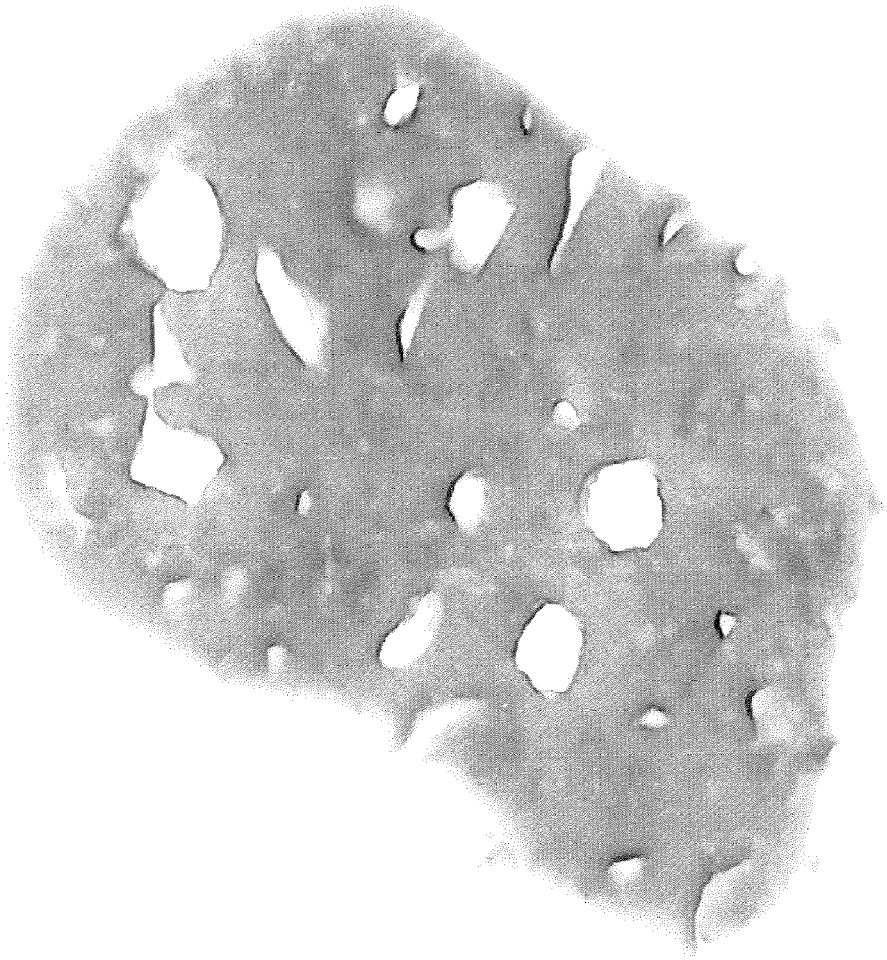
FIG. 9 is a cross-sectional TEM image of toner G for development.
Figure 10:
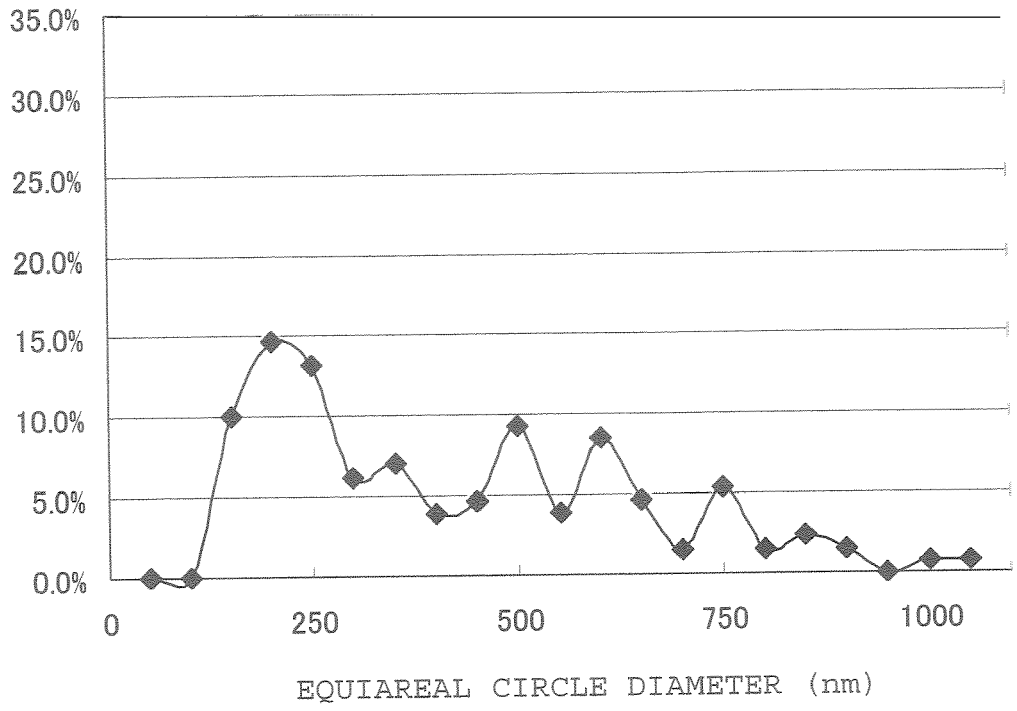
FIG. 10 is the equiareal circle diameter distribution in number of wax domains in toner G for development.

The cross-section of the toner G for development was dyed with ruthenium tetroxide and observed by a transmission electron microscope (TEM), and the results are shown in FIG. 9. By utilizing a phenomenon such that ruthenium tetroxide was deposited at the interface between the wax domain and the resin, from the TEM image, 129 wax domains were identified, and their areas were measured by the image analysis, whereby their equiareal circular diameter distribution was obtained, and the results are shown in FIG. 10. Some of these domains were found to have leached out on the toner surface.

INDUSTRIAL APPLICABILITY

The toner of the present invention is useful as a toner for developing an electrostatic charge image, which is useful for a printing machine or a copying machine required to provide a uniform and high quality image in a case where a large amount of electrostatic development is carried out at a high speed, in a case where electrostatic development is carried out continuously for is a long period of time, or in a case where the electrostatic development is carried out in a high temperature high humidity environment.

The entire disclosure of Japanese Patent Application No. 2004-337714 filed on Nov. 22, 2004 including specification, claims, drawings and summary is incorporated herein by reference in its entirety.

The invention claimed is:

1. A toner for developing an electrostatic charge image, which comprises a binder resin and wax, wherein the binder resin comprises a copolymer prepared by using as a starting material, a (meth)acrylate monomer having a $C_{8-100}$ linear hydrocarbon group, and the content of the (meth)acrylate monomer having a $C_{8-100}$ linear hydrocarbon group is less than 2 wt % of the entire binder resin and—wherein the number of wax domains satisfying the following formula (1) among wax domains observed by its TEM analysis, is at least 85.0% of the total:

(1) $0<A<500$ (A: equiareal circle diameter (nm))

wherein said copolymer is present at the interface between the binder resin and the wax, and wherein said toner is produced by a process comprising supplying a monomer into an aqueous dispersion containing wax and a (meth)acrylate having a $C_{8-100}$ linear hydrocarbon group, carrying out the polymerization, followed by flocculation treatment.

2. The toner according to claim 1, wherein the number of wax domains satisfying the following formula (2) among wax domains observed by its TEM analysis, is at least 60.0% of the total:

(2) $0<A<350$ (A: equiareal circle diameter (nm)).

3. The toner according to claim 1, wherein the number of wax domains satisfying the following formula (3) among wax domains observed by its TEM analysis, is at least 40.0% of the total:

(3) $0<A<250$ (A: equiareal circle diameter (nm)).

4. The toner according to claim 3, wherein the number of wax domains satisfying the formula (3) is at least 50.0% of the total.

5. The toner according to claim 1, wherein the number of wax domains satisfying the following formula (4) among wax domains observed by its TEM analysis, is at least 15.0% of the total:

(4) $50<A<150$ (A: equiareal circle diameter (nm)).

6. The toner according to claim 5, wherein the number of wax domains satisfying the formula (4) is at least 25.0% of the total.

7. The toner according to claim 1, wherein the main peak in the equiareal circle diameter distribution in number of wax domains observed by its TEM analysis, is present at less than 200 nm.

8. The toner according to claim 7, wherein the main peak in the equiareal circle diameter distribution in number of wax domains observed by its TEM analysis, is present at 100 or larger nm.

9. The toner according to claim 1, wherein the volume dispersed particle diameter of the aqueous dispersion is at most 2 μm.

10. The toner according to claim 1, wherein the (meth) acrylate monomer having a $C_{8-100}$ linear hydrocarbon group is a (meth)acrylate monomer having a $C_{12-100}$ linear hydrocarbon group.

11. The toner according to claim 1, wherein the hydrocarbon in the (meth)acrylate monomer having a $C_{8-100}$ linear hydrocarbon group is at least one member selected from the group consisting of lauryl, cetyl and stearyl groups.

* * * * *